US011830442B2

(12) United States Patent
Oh et al.

(10) Patent No.: US 11,830,442 B2
(45) Date of Patent: Nov. 28, 2023

(54) GAMMA VOLTAGE GENERATING CIRCUIT FOR USE IN DISPLAY DEVICE HAVING FIRST AND SECOND PIXEL AREAS, AND DISPLAY DEVICE INCLUDING THE SAME

(71) Applicant: LG Display Co., Ltd., Seoul (KR)

(72) Inventors: Seung Taek Oh, Paju-si (KR); Kyu Jin Kim, Paju-si (KR); Bo Yun Jung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/947,350

(22) Filed: Sep. 19, 2022

(65) Prior Publication Data

US 2023/0119029 A1 Apr. 20, 2023

(30) Foreign Application Priority Data

Oct. 18, 2021 (KR) ..... 10-2021-0138147

(51) Int. Cl.
*G09G 5/00* (2006.01)
*G09G 3/3291* (2016.01)

(52) U.S. Cl.
CPC ... *G09G 3/3291* (2013.01); *G09G 2310/0297* (2013.01); *G09G 2320/0276* (2013.01); *G09G 2320/0673* (2013.01)

(58) Field of Classification Search
CPC ..... G09G 3/3291; G09G 2310/0297; G09G 2320/0276; G09G 2320/0673
USPC ..... 345/204
See application file for complete search history.

(56) References Cited

U.S. PATENT DOCUMENTS

| | | | | |
|---|---|---|---|---|
| 2006/0087483 | A1* | 4/2006 | Takada | G09G 3/3688 345/89 |
| 2017/0076656 | A1* | 3/2017 | Bang | G09G 3/2092 |
| 2019/0087620 | A1* | 3/2019 | Kim | G06V 40/1318 |
| 2019/0362672 | A1* | 11/2019 | Cui | H01L 27/3265 |
| 2020/0286448 | A1* | 9/2020 | Kim | G09G 3/3275 |

* cited by examiner

*Primary Examiner* — Jennifer T Nguyen
(74) *Attorney, Agent, or Firm* — Morgan, Lewis & Bockius LLP

(57) ABSTRACT

The present disclosure relates to a gamma voltage generating circuit and a display device including the same. The gamma voltage generating circuit may include: a first output terminal to output a first gamma voltage set as a black grayscale voltage; a second output terminal to output a second gamma voltage set as a higher grayscale voltage than the black grayscale voltage; a third output terminal to output a third gamma voltage set as a highest grayscale voltage of the first pixel area; and a fourth output terminal to output a fourth gamma voltage set as a highest grayscale voltage of the second pixel area.

14 Claims, 18 Drawing Sheets

GAMMA VOLTAGE GENERATING CIRCUIT FOR USE IN DISPLAY DEVICE HAVING FIRST AND SECOND PIXEL AREAS, AND DISPLAY DEVICE INCLUDING THE SAME

CROSS-REFERENCE TO RELATED APPLICATION

This application claims priority to and the benefit of Korean Patent Application No. 10-2021-0138147, filed on Oct. 18, 2021, the disclosure of which is incorporated herein by reference in its entirety.

BACKGROUND

1. Technical Field

The present disclosure relates to a gamma voltage generating circuit configured to output a gamma voltage set by a bilinear or bi-section gamma curve, and a display device using the same.

2. Discussion of the Related Art

Electroluminescent display devices may generally be classified into inorganic light emitting display devices and organic light emitting display devices according to materials of light emitting layers. Active matrix type organic light emitting display devices include organic light-emitting diodes (hereinafter referred to as "OLEDs"), which emit light by themselves. Such organic light emitting display devices have fast response speeds and advantages in which light emission efficiencies, brightness, and viewing angles are high. In the organic light-emitting display devices, the OLEDs are formed in pixels. Since the organic light-emitting display devices have fast response speeds and are excellent in light emission efficiency, brightness, and viewing angle as well as being able to exhibit a black gradation in a full black color, the organic light-emitting display devices are excellent in a contrast ratio and color reproducibility.

Multimedia functions of mobile terminals are improving. For example, it is a trend that a camera is basically built-in in a smartphone, and the resolution of the built-in cameras is increasing to the level of existing digital cameras. A front camera of the smartphone limits screen design, making designing of the screen difficult. In order to reduce space occupied by the front camera, screen designs including a notch or a punch hole have been adopted in smartphones, but the size of the screen was still limited due to the camera so that a full screen display could not be realized.

SUMMARY

In order to implement a full-screen display, a sensing area in which low-resolution pixels may be disposed in a screen of a display panel may be provided. Since the number of pixels lit in the low-resolution pixel area is relatively few, the pixels in the low-resolution pixel area can be driven with a relatively high data voltage for uniform luminance of the entire screen. To this end, a gamma tap configured to drive pixels in the low-resolution pixel area with high luminance in a conventional gamma voltage generating circuit set to a nonlinear 2.2 gamma curve may be added. As a result, not only does the gamma voltage generating circuit become complex and large, but also the number of inflection points in the 2.2 gamma curve may increase. Additionally, due to the gamma voltage range for driving the low-resolution pixel, the gamma voltage range of the high-resolution pixel area corresponding to a main display unit may be reduced so that the digital gamma resolution may be reduced.

Accordingly, embodiments of the present disclosure are directed to gamma voltage generating circuit and display device including the same that substantially obviate one or more problems due to the aforementioned limitations and disadvantages.

The present disclosure provides a gamma voltage generating circuit and a display device including the same that are capable of reducing the number of gamma voltages to be supplied to pixels of the low-resolution pixel area and the high-resolution pixel area and improving digital gamma resolution.

The features and aspects of the present disclosure are not limited to those mentioned above. Additional features and aspects will be set forth in part in the description that follows and in part will become apparent to those skilled in the art from the description or may be learned by practice of the inventive concepts provided herein. Other features and aspects of the inventive concepts may be realized and attained by the structure particularly pointed out in, or derivable from, the written description, the claims hereof, and the appended drawings.

To achieve these and other advantages and in accordance with the purpose of the disclosure, as embodied and broadly described herein, a gamma voltage generating circuit for use in a display device having a first pixel area and a second pixel area is disclosed. The gamma voltage generating circuit may include: a first output terminal to output a first gamma voltage set as a black grayscale voltage; a second output terminal to output a second gamma voltage set as a higher grayscale voltage than the black grayscale voltage; a third output terminal to output a third gamma voltage set as a highest grayscale voltage of the first pixel area; and a fourth output terminal to output a fourth gamma voltage set as a highest grayscale voltage of the second pixel area.

In another aspect, a display device according to an example embodiment of the present disclosure may include: a display panel including a first pixel area, a second pixel area, and a plurality of data lines respectively connected to pixels of the first pixel area and the second pixel area; a data driver configured to supply a data voltage to the data lines; and a gamma voltage generating circuit configured to supply first, second, third, and fourth gamma voltages to the data driver. The gamma voltage generating circuit may include: a first output terminal to output a first gamma voltage set as a black grayscale voltage; a second output terminal to output a second gamma voltage set as a higher grayscale voltage of the black grayscale voltage; a third output terminal to output a third gamma voltage set as a highest grayscale voltage of the first pixel area; and a fourth output terminal to output a fourth gamma voltage set as a highest grayscale voltage of the second pixel area.

It is to be understood that both the foregoing general description and the following detailed description of the present disclosure are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings.

DETAILED DESCRIPTION

Figure 1:
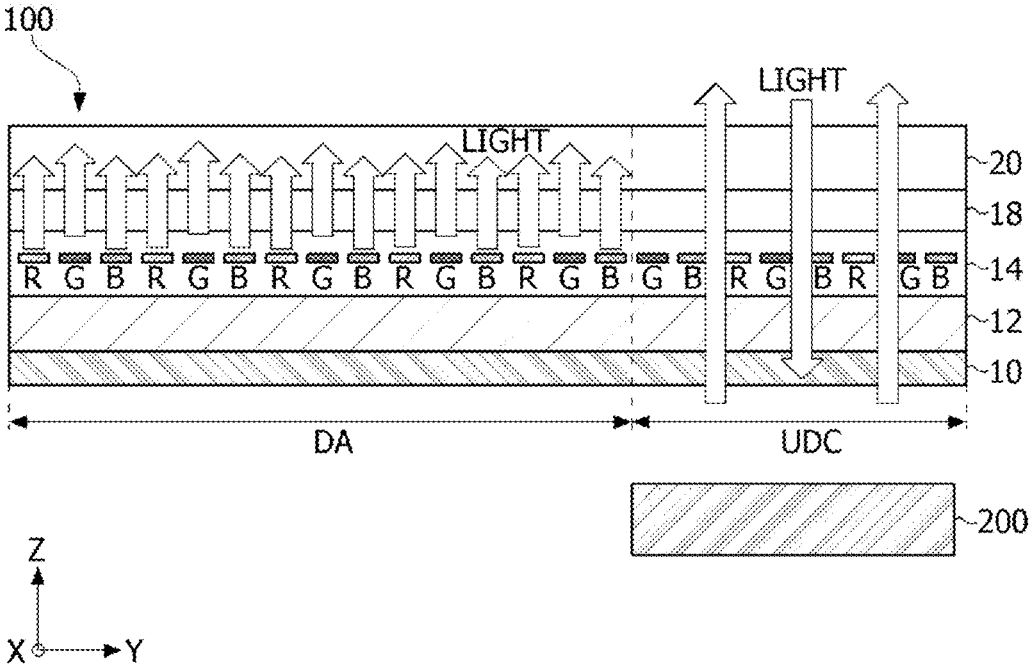
FIG. 1 is a cross-sectional view schematically illustrating a display panel according to an example embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The protected scope of the present disclosure is only defined within the scope of the accompanying claims and their equivalents.

The shapes, sizes, ratios, angles, numbers, and the like, which are illustrated in the drawings to describe various example embodiments of the present disclosure, are merely given by way of example. Therefore, the present disclosure is not limited to the illustrations in the drawings. Like reference numerals generally denote like elements throughout the present specification, unless otherwise specified.

Further, in the following description, where the detailed description of a relevant known function or configuration may unnecessarily obscure the subject matter of the present disclosure, a detailed description of such known function or configuration may be omitted.

Where the terms "comprise," "have," "include," and the like are used, one or more other elements may be added unless the term, such as "only," is used. An element described in the singular form is intended to include a plurality of elements, and vice versa, unless the context clearly indicates otherwise.

In construing an element, the element is to be construed as including an ordinary error or tolerance range even where no explicit description of such an error or tolerance range is provided.

Where positional relationships are described, for example, where the positional relationship between two parts is described using "on," "over," "under," "above," "below," "beside," "next," or the like, one or more other parts may be located between the two parts unless a more limiting term, such as "immediate(ly)," "direct(ly)," or "close(ly)" is used. For example, where an element or layer is disposed "on" another element or layer, a third layer or element may be interposed therebetween.

Although the terms "first," "second," A, B, (a), (b), and the like may be used herein to describe various elements, these elements should not be interpreted to be limited by these terms as they are not used to define a particular order, precedence, or number of the corresponding elements. These terms are used only to distinguish one element from another. For example, a first element could be termed a second element, and, similarly, a second element could be termed a first element, without departing from the scope of the present disclosure.

The same reference numerals may refer to substantially the same elements throughout the present disclosure unless otherwise specified.

Features of various embodiments of the present disclosure may be partially or entirely coupled to or combined with each other. They may be linked and operated technically in various ways as those skilled in the art can sufficiently understand. The embodiments may be carried out independently of or in association with each other in various combinations.

In a display device of the present disclosure, a pixel circuit may include a plurality of transistors. Transistors may be implemented as oxide thin film transistors (oxide TFTs) including an oxide semiconductor, low temperature polysilicon (LTPS) TFTs including low temperature polysilicon, or the like. Each of the transistors may be implemented as a p-channel TFT or an n-channel TFT.

Generally, a transistor is a three-electrode element including a gate, a source, and a drain. The source is an electrode configured to supply carriers to the transistor. In the transistor, carriers may flow from the source. The drain is an electrode through which carriers may exit from the transistor. In a transistor, carriers may flow from a source to a drain.

In the case of an n-channel transistor, since carriers are electrons, a source voltage is configured to be lower than a drain voltage such that electrons may flow from a source to a drain. The n-channel transistor has a direction of a current flowing from the drain to the source. In the case of a p-channel transistor, since carriers are holes, a source voltage is configured to be higher than a drain voltage such that holes may flow from a source to a drain. In the p-channel transistor, since holes flow from the source to the drain, a current may flow from the source to the drain. It should be noted that a source and a drain of a transistor are not fixed. For example, a source and a drain may be switched according to an applied voltage. Therefore, the disclosure is not limited based on a reference to a given electrode of a transistor as a source or a drain of the transistor. In the following description, a source and a drain of a transistor will be referred to as a first electrode and a second electrode.

A gate signal is configured to swing between a gate-on voltage and a gate-off voltage. The transistor is configured to be turned on in response to the gate-on voltage and to be turned off in response to the gate-off voltage.

In the case of the n-channel transistor, a gate-on voltage may be a gate high voltage VGH and VEH, and a gate-off voltage may be a gate low voltage VGL and VEL. In the case of the p-channel transistor, a gate-on voltage may be a gate low voltage VGL and VEL, and a gate-off voltage may be a gate high voltage VGH and VEH.

Reference will now be made in detail to embodiments of the present disclosure, examples of which may be illustrated in the accompanying drawings. In the following description of embodiments, a display device will be described based on an organic light emitting display device as an example display device, but the present disclosure is not limited thereto.

Figure 2:
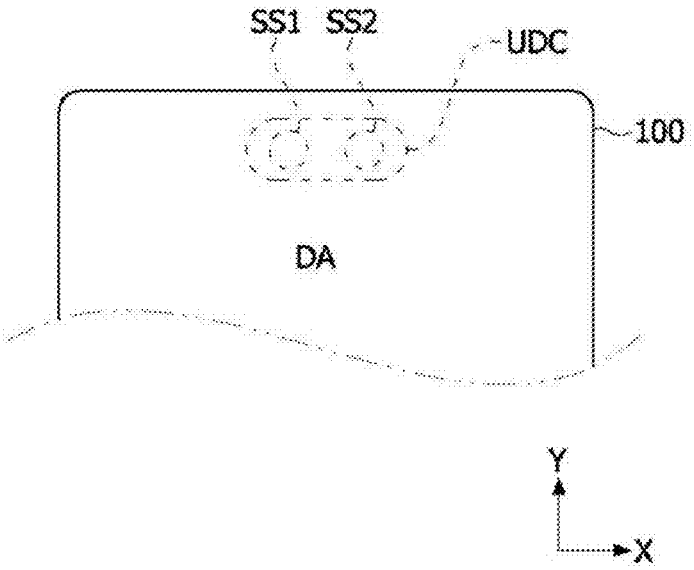
FIG. 2 is a plan view illustrating an area in which a sensor module is disposed within a screen of the display panel.

As illustrated in FIGS. 1 and 2, a display panel 100 may include a screen that reproduces an input image. A pixel array of the screen may be divided into first and second pixel areas DA and UDC having at least different resolutions from each other.

Each of the first pixel area DA and the second pixel area UDC includes pixels in which pixel data of an input image may be written. The second pixel area UDC may be a pixel area having a lower resolution than the first pixel area DA. The first pixel area may include pixels disposed with a high pixels-per-inch (PPI). The second pixel area UDC may include pixels disposed with a lower PPI than the PPI of the first pixel area DA. A sensor module 200 may be disposed under the display panel 100 to face the second pixel area UDC.

As shown in FIG. 2, at least a portion of the sensor modules SS1 and SS2 may be disposed under the display panel 100 to overlap the second pixel area UDC. Accordingly, one or more sensor modules SS1 and SS2 may face the second pixel area UDC.

For example, various sensors, such as an imaging module including an image sensor, an infrared sensor module, and an illuminance sensor module, may be disposed under the second pixel area UDC of the display panel 100. The second pixel area UDC may include a light transmitting part to increase transmittance of light directed to the sensor modules.

Since each of the first pixel area DA and the second pixel area UDC includes pixels, the input image may be displayed in the first pixel area DA and the second pixel area UDC.

Each of the pixels of the first pixel area DA and the second pixel area UDC may include sub-pixels having different colors to implement colors of an image. The sub-pixels may include red (hereinafter referred to as an "R sub-pixel"), green (hereinafter referred to as a "G sub-pixel"), and blue (hereinafter referred to as a "B sub-pixel"). Although not shown, each of the pixels P may further include a white sub-pixel (hereinafter referred to as a "W sub-pixel"). Each of the sub-pixels may include a pixel circuit configured to drive a light emitting element in the sub-pixel.

An image quality compensation algorithm for compensating for luminance and color coordinates of pixels in the second pixel area UDC having a lower PPI than the first pixel area DA may be applied.

In example embodiments of the display device of the present disclosure, since pixels are disposed in the second pixel area UDC overlapping the sensor module, the display area of the screen may not be limited by the sensor module. Accordingly, the display device of the present disclosure can implement a screen of a full-screen display.

The display panel 100 has a width in an X-axis direction, a length in a Y-axis direction, and a thickness in a Z-axis direction. The display panel 100 may include a circuit layer 12 disposed on a substrate 10 and a light emitting element layer 14 disposed on the circuit layer 12. A polarizing plate 18 may be disposed on the light emitting element layer 14, and a cover glass 20 may be disposed on the polarizing plate 18.

The circuit layer 12 may include a pixel circuit connected to lines, such as data lines, gate lines, power lines, and the like, and a gate driving part connected to the gate lines. The circuit layer 12 may include circuit elements, such as transistors implemented with thin film transistors (TFTs), a capacitor, and the like. The lines and circuit elements of the circuit layer 12 may be implemented with a plurality of insulating layers, two or more metal or conductive layers spaced apart from each other with an insulating layer therebetween, and an active layer including a semiconductor material.

The light emitting element layer 14 may include a light emitting element driven by the pixel circuit. The light emitting element may be implemented with an organic light emitting diode (OLED). The OLED includes an organic compound layer formed between an anode and a cathode. The organic compound layer may include a hole injection layer (HIL), a hole transport layer (HTL), an emission layer (EML), an electron transport layer (ETL), and an electron injection layer (EIL), but the present disclosure is not limited thereto. When a voltage is applied to the anode and the cathode of the OLED, holes passing through the hole transport layer (HTL) and electrons passing through the electron transport layer (ETL) may move to the emission layer (EML) and then form excitons. Thus, visible light may be emitted from the emission layer (EML). The OLED used as the light emitting element EL may have a tandem structure in which a plurality of emission layers are stacked. The OLED having the tandem structure may improve the luminance and lifespan of the pixels. The light emitting element layer 14 may be disposed on pixels which selectively transmit red, green, and blue wavelengths, and may further include a color filter array.

A light emitting element layer 14 may be covered by a protective film, and the protective film may be covered by an encapsulation layer. The protective layer and the encapsulation layer may have a structure in which organic films and inorganic films are alternately stacked. The inorganic film may block or mitigate penetration of moisture and oxygen. The organic film may planarize the surface of the inorganic film. If the organic films and the inorganic films are stacked in multiple layers, the movement path of moisture or oxygen becomes longer than that in a single layer, so that the penetration of moisture/oxygen affecting the light emitting element layer 14 can be effectively blocked or reduced.

A polarizing plate 18 may be adhered to the encapsulation layer covering the light emitting layer 14. The polarizing plate 18 may improve outdoor visibility of the display device. The polarizing plate 18 may improve the brightness of pixels by reducing light reflected from the surface of the display panel 100 and blocking light reflected from the metal of a circuit layer 12. The polarizing plate 18 may be implemented as a polarizing plate in which a linear polarizing plate and a phase retardation film are bonded together or as a circular polarizing plate.

Figure 3:
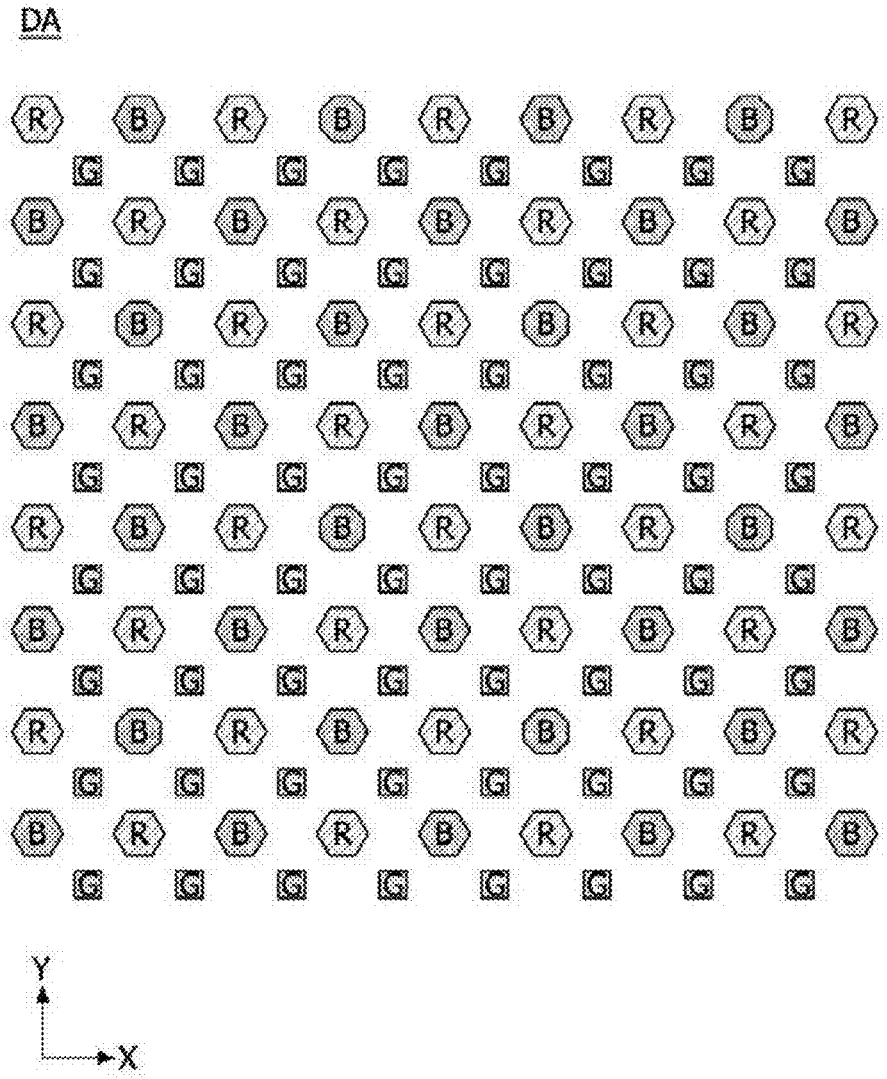
FIG. 3 is a view illustrating an example pixel arrangement in a first pixel area.
Figure 4:
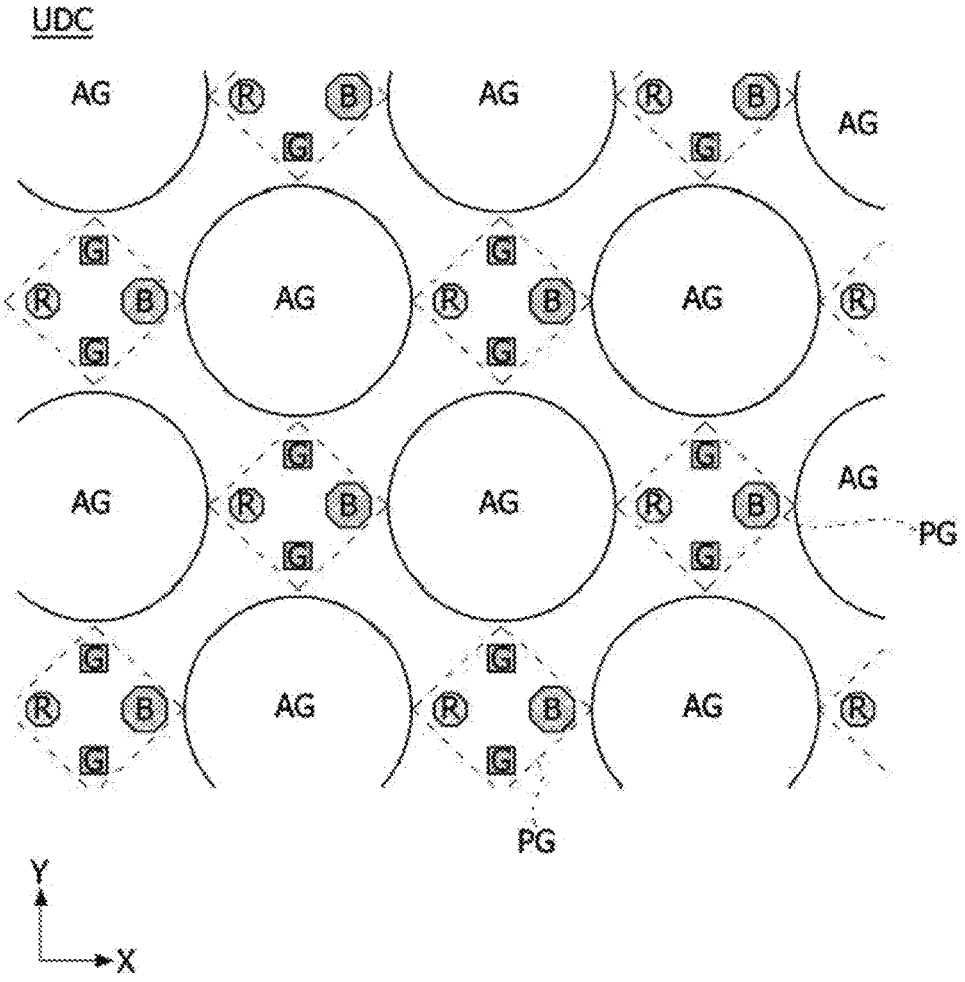
FIG. 4 is a view illustrating an example pixel arrangement in a second pixel area.

FIG. 3 is a view illustrating an example of a pixel arrangement in the first pixel area DA. FIG. 4 is a view illustrating an example arrangement of pixels and light transmitting parts in the second pixel area UDC. Wirings connected to the pixels are not illustrated in FIGS. 3 and 4.

As shown in FIG. 3, the first pixel area DA may include pixels arranged with a high PPI. Each of the pixels may be implemented as a real-type pixel in which R, G, and B sub-pixels of three primary colors are configured as one pixel. Each of the pixels may further include a W sub-pixel, which is not illustrated in the drawing.

In each of the pixels, two sub-pixels may constitute one pixel using a sub-pixel rendering algorithm. For example, a first pixel may be composed of R and first G sub-pixels, and a second pixel may be composed of B and second G sub-pixels. Insufficient color representation in each of the first and second pixels may be compensated for by an average value of corresponding color data between neighboring pixels.

In the sub-pixels, the luminous efficiency of the light emitting element may be different for each color. In consideration of this, the sizes of the sub-pixels may be different for each color. For example, among the R, G, and B sub-pixels, the B sub-pixel may be the largest, and the G sub-pixel may be the smallest.

As shown in FIG. 4, the second pixel area UDC may include a plurality of pixel group spaced apart from each other by a predetermined distance and light transmitting parts AG disposed between adjacent pixel groups PG. The pixel group may include sub-pixels disposed in an area indicated by a dotted line in FIG. 4.

External light may be received by the lens of the sensor module through the light transmitting parts AG. The light transmitting parts AG may include a transparent medium having high transmittance without a metal, so that light can be incident with minimal light loss. In other words, the light transmitting parts AG may be formed of transparent insulating materials without including metal wirings or pixels. Due to the light transmitting parts AG, the PPI of the second pixel area UDC may be lower than that of the first pixel area DA.

In the second pixel area UDC, the pixel group PG may include one or two pixels. Each of the pixels of the pixel group PG may include two to four sub-pixels. For example, one pixel in the pixel group PG may include R, G, and B sub-pixels or include two sub-pixels, and further include a W sub-pixel. In the example of FIG. 4, the first pixel may be composed of R and G sub-pixels, and the second pixel may be composed of B and G sub-pixels, but the present disclosure is not limited thereto.

The shape of the light-transmitting parts AG is illustrated as a circular shape in FIG. 4, but it is not limited thereto. For example, the light transmitting parts AG may be designed in various shapes, such as a circular shape, an elliptical shape, and a polygonal shape.

Due to process variation and element characteristic variation caused in the manufacturing process of the display panel, there may be a difference in electrical characteristics of a driving element between pixels, and the difference may increase as the driving time of the pixels elapses. Internal compensation technology or external compensation technology may be applied to an organic light emitting display device to compensate for variations in electrical characteristics of the driving element between pixels.

The internal compensation technology may sense a threshold voltage of the driving element for each sub-pixel using an internal compensation circuit implemented in each pixel circuit and may compensate a gate-source voltage Vgs of the driving element by the threshold voltage. The external compensation technology may sense a current or voltage of the driving element that changes according to the electrical characteristics of the driving element in real time using an external compensation circuit. The external compensation technology may compensate for the deviation (or change) in the electric characteristic of the driving element in each pixel in real time by modulating the pixel data (digital data) of the input image by the electric characteristic deviation (or change) of the driving element sensed for each pixel.

Figure 5:
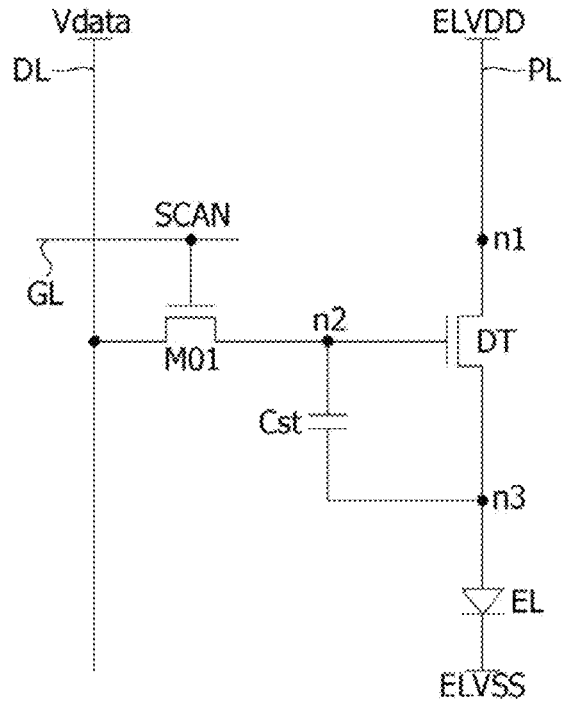
FIGS. 5 to 7 are circuit diagrams illustrating various example pixel circuits applicable to a display device according to an example embodiment of the present disclosure.
Figure 6:
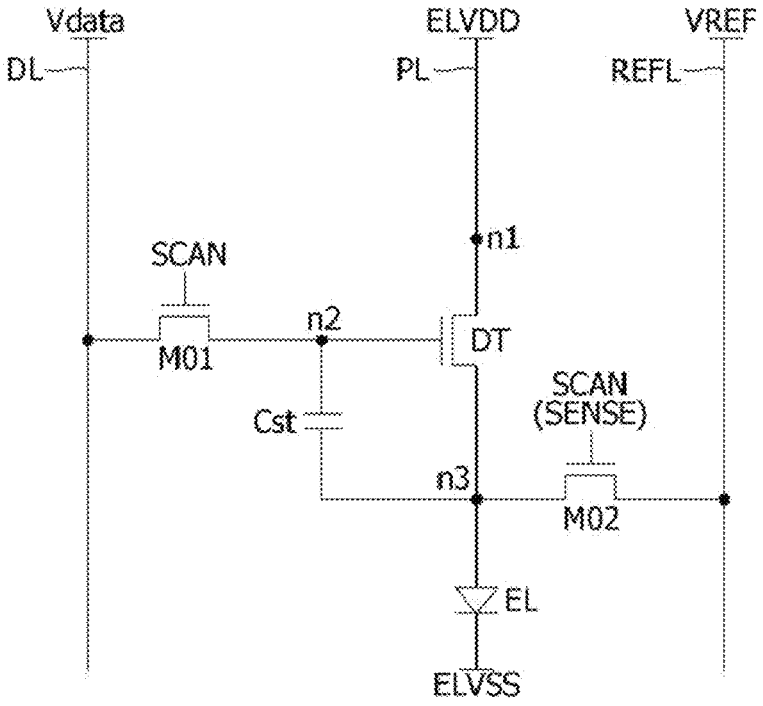
Figure 7:
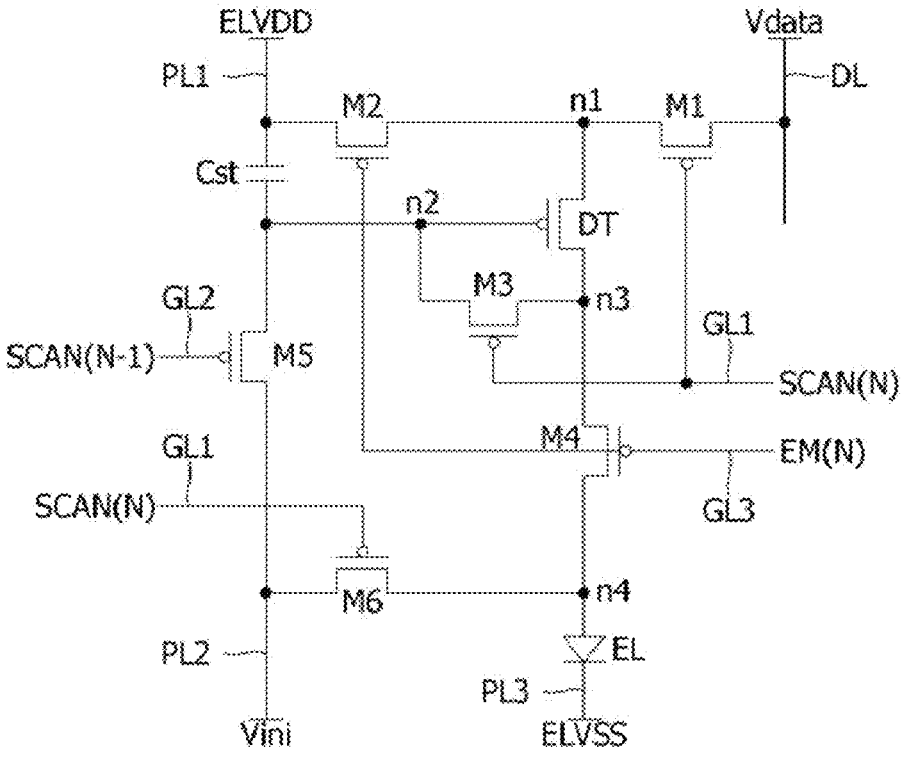

FIGS. 5 to 7 are circuit diagrams illustrating various example pixel circuits applicable to a display device according to example embodiments of the present disclosure.

As shown in FIG. 5, the pixel circuit may include a light emitting element EL, a driving element DT configured to supply a current to the light emitting element EL, a switch element M01 configured to connect a data line DL to a second node n2 in response to a scan pulse SCAN, and a capacitor Cst connected between the second node n2 and a third node n3. The driving element DT and the switch element M01 may be implemented with n-channel transistors.

The driving element DT may include a gate electrode connected to the second node n2, a first electrode connected to a first node n1, and a second electrode connected to the third node n3. A VDD line PL to which a pixel driving voltage ELVDD may be applied is connected to the first node n1. The light emitting element EL may include an anode connected to the third node n3 and a cathode connected to a VSS line to which a low potential power voltage ELVSS may be applied.

The driving element DT may drive the light emitting element EL by supplying a current to the light emitting element EL according to the gate-source voltage Vgs. The light emitting element EL may be turned on and emit light when a forward voltage between the anode and the cathode is equal to or greater than a threshold voltage. The capacitor Cst may be connected between the gate electrode and a source electrode of the driving element DT to maintain the gate-source voltage Vgs of the driving element DT.

FIG. 6 is another example of the pixel circuit.

As shown in FIG. 6, the pixel circuit may further include a second switch element M02 connected between a reference voltage line REFL and the third node n3 connected to the second electrode of the driving element DT. In this example pixel circuit, the driving element DT and the switch elements M01 and M02 may be implemented with n-channel transistors.

The second switch element M02 may apply a reference voltage VREF to the third node n3 in response to the scan pulse SCAN or a separate sensing pulse SENSE. The reference voltage VREF may be applied to the pixel circuit through the REF line REFL.

In a sensing mode, a current flowing through the channel of the driving element DT or a voltage at the third node n3 between the driving element DT and the light emitting element EL may be sensed through the reference line REFL. The current flowing through the reference line REFL may be converted into a voltage through an integrator and be converted into digital data through an analog-to-digital converter (hereinafter referred to as an "ADC"). This digital data may be sensing data including threshold voltage or mobility information of the driving element DT. The sensing data may be transmitted to a data operation part. The data operation part may receive the sensing data from the ADC and compensate for driving deviation and deterioration of pixels by adding a compensation value selected based on the sensing data to the pixel data or by multiplying the pixel data by the compensation value selected based on the sensing data.

Figure 8:
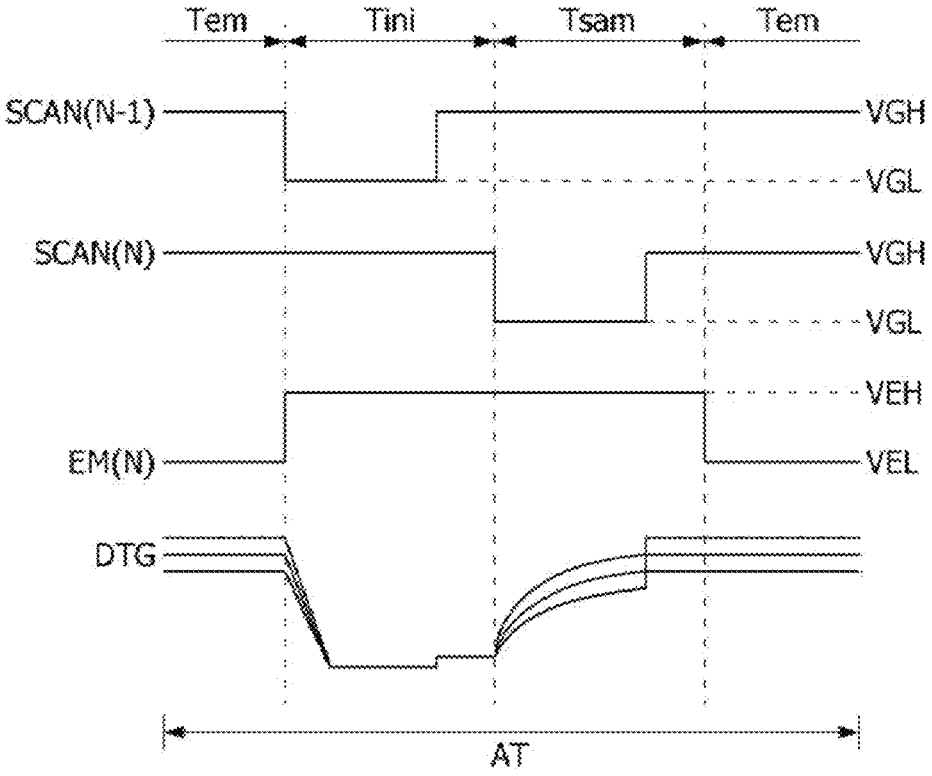
FIG. 8 is a waveform diagram illustrating a method of driving the example pixel circuit shown in FIG. 7.

FIG. 7 is a circuit diagram illustrating still another example of the pixel circuit. FIG. 8 is a waveform diagram illustrating an example method of driving the example pixel circuit shown in FIG. 7.

As shown in FIGS. 7 and 8, the pixel circuit may include a light emitting element EL, a driving element DT configured to supply a current to the light emitting element EL, and a switch circuit configured to switch a voltage applied to the light emitting element EL and the driving element DT.

The switch circuit may be connected to power lines PL1, PL2, and PL3 to which a pixel driving voltage ELVDD, a low potential power voltage ELVSS, and an initialization voltage Vini may be applied. The switch circuit may further be connected to a data line DL and gate lines GL1, GL2 and GL3, and may switch voltages applied to the light emitting element EL and the driving element DT in response to a gate signal. The gate signal may include scan pulses SCAN(N-1) and SCAN(N) and an emission control pulse (hereinafter, referred to as an "EM pulse") EM(N).

The switch circuit may include an internal compensation circuit that samples a threshold voltage Vth of the driving element DT using a plurality of switch elements M1 to M6, stores the voltages in a capacitor Cst, and compensates for the gate voltage of the driving element DT by the threshold voltage Vth of the driving element DT. Each of the driving element DT and the switch elements M1 to M6 may be implemented with a p-channel TFT.

A driving period of the pixel circuit may be divided into an initialization period Tini, a sampling period Tsam, and a light emission period Tem, as shown in FIG. 8.

An $N^{th}$ scan pulse SCAN(N) may be generated as a gate-on voltage VGL in the sampling period Tsam and be applied to a first gate line GL1. An $(N-1)^{th}$ scan pulse SCAN(N-1) may be generated as the gate-on voltage VGL in the initialization period Tini prior to the sampling period and be applied to a second gate line GL2. The EM pulse EM(N) may be generated as a gate-off voltage VEH in the initialization period Tini and the sampling period Tsam and be applied to a third gate line GL3.

During the initialization period Tini, the (N−1)th scan pulse SCAN(N-1) may be generated as the gate-on voltage VGL, and each of the Nth scan pulse SCAN(N) and the EM pulse EM(N) may be at their respective gate-off voltage VGH and VEH. During the sampling period Tsam, the Nth scan pulse SCAN(N) may be generated as a pulse of the gate-on voltage VGL, and each of the (N−1)th scan pulse SCAN(N-1) and the EM pulse EM(N) may be at their respective gate-off voltage VGH and VEH. The EM pulse EM(N) may be generated as the gate-on voltage VEL during at least a part of the light emission period Tem, and each of the (N−1)th scan pulse SCAN(N-1) and the Nth scan pulse SCAN (N) may be at their gate-off voltage VGH.

During the initialization period Tini, a fifth switch element M5 may be turned on according to the gate-on voltage VGL of the (N−1)th scan pulse SCAN(N-1) to initialize the pixel circuit. During the sampling period Tsam, first and third switch elements M1 and M3 may be turned on according to the gate-on voltage VGL of the Nth scan pulse SCAN(N), and a data voltage Vdata compensated for by the threshold voltage of the driving element DT may be stored in the capacitor Cst. At the same time, a sixth switch element M6 may be turned on during the sampling period Tsam and may lower the voltage of a fourth node n4 to the initialization voltage Vini to suppress light emission of the light emitting element EL.

During the light emission period Tem, the second and fourth switch elements M2 and M4 may be turned on, and the light emitting element EL may emit light. During the light emission period Tem, to express the luminance of low grayscale more accurately, a voltage level of the EM pulse EM(N) may be switched at a predetermined duty ratio between the gate-on voltage VEL and the gate-off voltage VEH. In this case, the second and fourth switch elements M2 and M4 may repeatedly turn on/off according to the duty ratio of the EM pulse EM(N) during the light emission period Tem.

The anode of the light emitting element EL may be connected to the fourth node n4 between the fourth and sixth switch elements M4 and M6. The fourth node n4 may be connected to the anode of the light emitting element EL, a second electrode of the fourth switch element M4, and a second electrode of the sixth switch element M6. The cathode of the light-emitting element EL may be connected to the VSS line PL3 to which the low potential power voltage ELVSS may be applied. The light emitting element EL may emit light with a current Ids flowing according to a gate-source voltage Vgs of the driving element DT. A current path of the light emitting element EL may be switched by the second and fourth switch elements M2 and M4.

The capacitor Cst may be connected between the VDD line PL1 and the second node n2. The data voltage Vdata compensated by the threshold voltage Vth of the driving element DT may be charged in the capacitor Cst. Since the data voltage Vdata in each of the sub-pixels may be compensated by the threshold voltage Vth of the driving element DT, the characteristic deviation of the driving element DT in the sub-pixels may be compensated for.

The third switch element M3 may be turned on in response to the gate-on voltage VGL of the Nth scan pulse SCAN(N) to connect the second node n2 to the third node n3. The second node n2 may be connected to a gate electrode of the driving element DT, a first electrode of the capacitor Cst, and a first electrode of the third switch element M3. The third node n3 may be connected to a second electrode of the driving element DT, a second electrode of the third switch element M3, and a first electrode of the fourth switch element M4. A gate electrode of the third switch element M3 may be connected to the first gate line GL1 to receive the Nth scan pulse SCAN(N). The first electrode of the third switch element M3 may be connected to the second node n2, and the second electrode of the third switch element M3 may be connected to the third node n3.

Since the third switch element M3 may be turned on during very short one horizontal period (1H) in which the Nth scan signal SCAN(N) is generated as the gate-on voltage VGL in one frame period, a leakage current may occur in an off state. To restrain the leakage current of the third switch element M3, the third switch element M3 may be implemented with a transistor having a dual gate structure in which two transistors are connected in series.

The first switch element M1 may be turned on in response to the gate-on voltage VGL of the Nth scan pulse SCAN(N) to supply the data voltage Vdata to the first node n1. A gate electrode of the first switch element M1 may be connected to the first gate line GL1 to receive the Nth scan pulse SCAN(N). A first electrode of the first switch element M1 may be connected to the first node n1. The second electrode of the first switch element M1 may be connected to the data lines DL of the first pixel area DA to which the data voltage Vdata may be applied. The first node n1 may be connected to the first electrode of the first switch element M1, a second electrode of the second switch element M2, and a first electrode of the driving element DT.

The second switch element M2 may be turned on in response to the gate-on voltage VEL of the EM pulse EM(N) to connect the VDD line PL1 to the first node n1. A gate electrode of the second switch element M2 may be connected to the third gate line GL3 to receive the EM pulse EM(N). A first electrode of the second switch element M2 may be connected to the VDD line PL1. The second electrode of the second switch element M2 may be connected to the first node n1.

The fourth switch element M4 may be turned on in response to the gate-on voltage VEL of the EM pulse EM(N) to connect the third node n3 to the fourth node n4 connected to the anode of the light emitting element EL. A gate electrode of the fourth switch element M4 may be connected to the third gate line GL3 to receive the EM pulse EM(N). The first electrode of the fourth switch element M4 may be connected to the third node n3, and the second electrode may be connected to the fourth node n4.

The fifth switch element M5 may be turned on in response to the gate-on voltage VGL of the (N−1)th scan pulse SCAN(N-1) to connect the second node n2 to the Vini line PL2. A gate electrode of the fifth switch element M5 may be connected to the second gate line GL2 to receive the (N−1)th scan pulse SCAN(N-1). A first electrode of the fifth switch element M5 may be connected to the second node n2, and its second electrode may be connected to the Vini line PL2. To restrain the leakage current of the fifth switch element M5, the fifth switch element M5 may be implemented with a transistor having a dual gate structure in which two transistors are connected in series.

The sixth switch element M6 may be turned on in response to the gate-on voltage VGL of the Nth scan pulse SCAN(N) to connect the Vini line PL2 to the fourth node n4. A gate electrode of the sixth switch element M6 may be connected to the first gate line GL1 to receive the Nth scan pulse SCAN(N). A first electrode of the sixth switch element M6 may be connected to the Vini line PL2, and its second electrode may be connected to the fourth node n4.

In another example embodiment, the gate electrodes of the fifth and sixth switch elements M5 and M6 may be commonly connected to the second gate line GL2 to which the (N−1)th scan pulse SCAN(N-1) may be applied. In this case, the fifth and sixth switch elements M5 and M6 may be simultaneously turned on in response to the (N−1)th scan pulse SCAN(N-1).

The driving element DT may drive the light emitting element EL by controlling the current flowing through the light emitting element EL according to the gate-source voltage Vgs of the driving element DT. The driving element DT may include a gate connected to the second node n2, the first electrode connected to the first node n1, and the second electrode connected to the third node n3. In FIG. 8, "DTG" is the gate voltage of the driving element DT, that is, the voltage at the second node n2.

It should be noted that the pixel circuit according to embodiments of the present disclosure is not limited to the examples illustrated in FIGS. 5 to 7. For example, the data voltage Vdata may be applied to the gate electrode of the driving element DT or be applied to the first electrode or the second electrode of the driving element DT. The gamma characteristic curve of the data voltage Vdata may be set as a positive gamma curve or an inverse gamma curve according to the channel characteristic of the driving element DT or an electrode to which the data voltage Vdata is applied. The data voltage Vdata may be applied to the first electrode or the second electrode of the n-channel driving element DT or may be applied to the gate electrode of the p-channel driving element DT. The data voltage Vdata applied to the gate electrode of the n-channel driving element DT may be a voltage determined by the positive gamma curve. The data voltage Vdata applied to the first electrode or the second electrode of the n-channel driving element DT may be a voltage determined by the inverse gamma curve. The data voltage Vdata applied to the gate electrode of the p-channel driving element DT may be a voltage determined by the inverse gamma curve. The data voltage Vdata applied to the first electrode or the second electrode of the p-channel driving element DT may be a voltage determined by the positive gamma curve.

Figure 9:
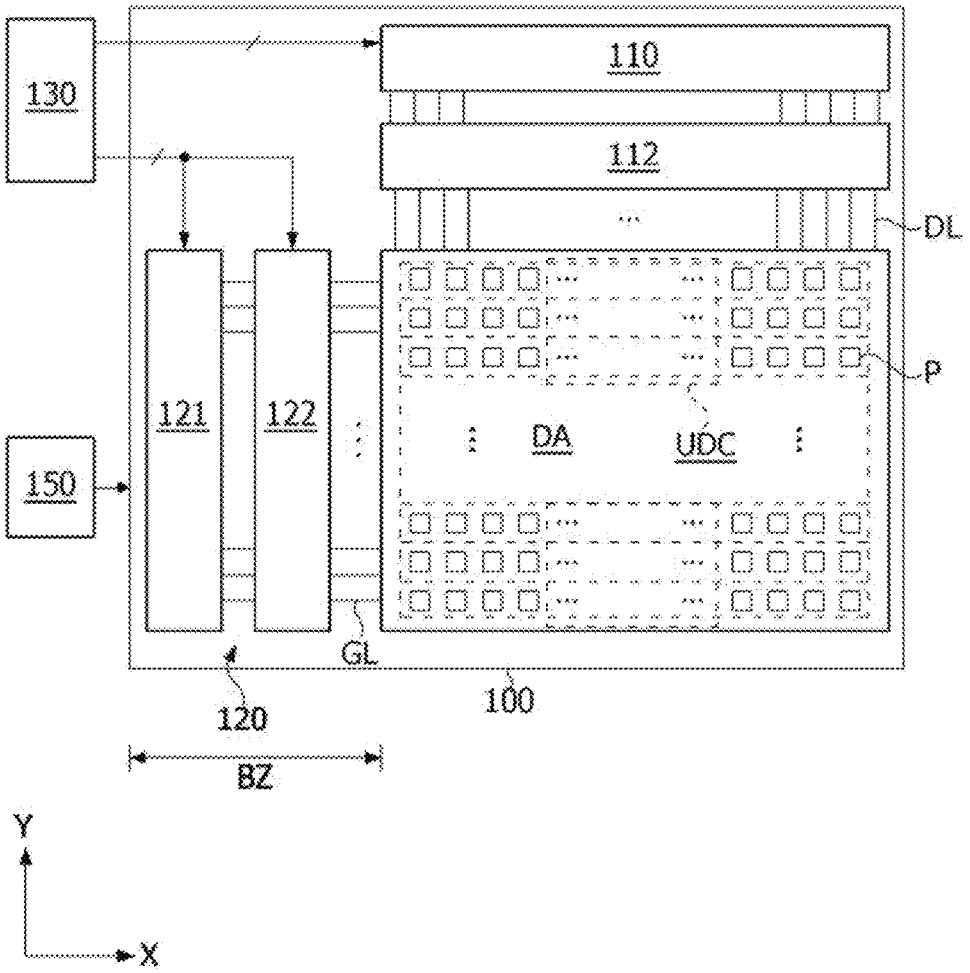
FIG. 9 is a block diagram illustrating the display device according to an example embodiment of the present disclosure.

FIG. 9 is a block diagram illustrating a display device according to an example embodiment of the present disclosure.

As shown in FIG. 9, a display device according to an embodiment of the present disclosure may include a display panel 100, display panel drivers 110 and 120 configured to write pixel data of an input image to pixels P of the display panel 100, a timing controller 130 configured to control the display panel drivers 110 and 120, and a power supply unit 150 configured to generate power to drive the display panel 100.

The display panel 100 may include a pixel array configured to display an input image on a screen. As described above, the pixel array may be divided into the first pixel area DA and the second pixel area UDC. The first pixel area DA may be larger than the second pixel area UDC. Accordingly, most of the input image may be displayed in the first pixel area DA. Each of the sub-pixels of the pixel array may drive the light emitting element EL, for example, using any of the example pixel circuits shown in FIGS. 5 to 7.

Touch sensors may be disposed on the screen of the display panel 100. The touch sensors may be implemented as on-cell type or add-on type touch sensors disposed on the screen of the display panel or may be implemented as in-cell type touch sensors embedded in the pixel array.

The display panel 100 may be implemented as a flexible display panel in which the pixels P are disposed on a flexible substrate, such as a plastic substrate or a metal substrate. In the flexible display, the size and shape of the screen may be changed by winding, folding, or bending the flexible display panel. The flexible display may include a slidable display, a rollable display, a bendable display, a foldable display, and the like.

The display panel driver may reproduce the input image on the screen of the display panel 100 by writing the pixel data of the input image to the sub-pixels. The display panel driver may include a data driver 110 and a gate driver 120. The display panel driver may further include a demultiplexer 112 disposed between the data driver 110 and data lines DL.

The display panel driver may operate in a low-speed driving mode under the control of the timing controller 130. In the low-speed driving mode, power consumption of the display device may be reduced when the input image does not change for a preset time by analyzing the input image. In the low-speed driving mode, when a still image is input for a predetermined time or longer, power consumption may be reduced by lowering a refresh rate of the pixels P and controlling the data writing period of the pixels P to be longer. The low-speed driving mode is not limited to when the still image is input. For example, when the display device operates in a standby mode or when a user command or an input image is not input to the display panel driving circuit for a predetermined time or longer, the display panel driving circuit may operate in the low-speed driving mode.

The data driver 110 may generate the data voltage Vdata using a digital-to-analog converter (hereinafter referred to as a "DAC") for pixel data of an input image, which is digital data. The DAC may receive pixel data, which is digital data, and may receive a gamma voltage from a gamma voltage generating circuit of the power supply unit 150. The DAC may be disposed in each of the channels of the data driver 110. The DAC may convert the pixel data into the data voltage Vdata using an array of switch elements that is configured to select a voltage in response to a bit of the pixel data. The data voltage output from each of the channels of the data driver 110 may be supplied to the corresponding data lines DL of the display panel 100 through the demultiplexer 112.

The demultiplexer 112 may time-divide and distribute the data voltage Vdata output through the channels of the data driver 110 to the plurality of data lines DL. The number of channels of the data driver 110 may be reduced due to the demultiplexer 112. The demultiplexer 112 may be omitted. In this case, the channels of the data driver 110 may be directly connected to the data lines DL.

The gate driver 120 may be implemented as a gate in panel (GIP) circuit that is directly formed on a bezel region BZ of the display panel 100 together with a TFT array of the pixel array. The gate driver 120 may output gate signals to gate lines GL under the control of the timing controller 130. The gate driver 120 may sequentially supply the gate signals to the gate lines GL by shifting the gate signals using a shift register. The voltage of the gate signals may swing between the gate-off voltage VGH and the gate-on voltage VGL. The gate signals may include the scan pulse, the EM pulse, the sensing pulse, etc., shown in FIGS. 5 to 7.

The gate driver 120 may be disposed on each of the left and right bezels of the display panel 100 to supply the gate signal to the gate lines GL in a double feeding method. In the double feeding method, the gate drivers 120 on both sides may be synchronized so that the gate signals may be simultaneously applied from both ends of one gate line. In another example embodiment, the gate driver 120 may be disposed on any one of the left and right bezels of the display panel 100 and may supply the gate signals to the gate lines GL in a single feeding method.

The gate driver 120 may include a first gate driver 121 and a second gate driver 122. The first gate driver 121 may output the scan pulse and the sensing pulse and may shift the scan pulse and the sensing pulse according to the shift clock. The second gate driver 122 may output a pulse of the EM signal and shift the EM pulse according to the shift clock. In the case of the bezel-free model, at least some of the switch elements composing the first and second gate drivers 121 and 122 may be dispersedly disposed in the pixel array.

The timing controller 130 may receive pixel data of an input image and timing signals synchronized with the pixel data from the host system. The timing signals may include a vertical synchronization signal Vsync, a horizontal synchronization signal Hsync, a clock CLK, a data enable signal DE, etc. One period of the vertical synchronization signal Vsync is one frame period. One period of each of the horizontal synchronization signal Hsync and the data enable signal DE is one horizontal period 1H. The pulse of the data enable signal DE may be synchronized with one line of data to be written to the pixels P of one pixel line. Since the frame period and the horizontal period can be determined by counting the data enable signal DE, the vertical synchronization signal Vsync and the horizontal synchronization signal Hsync may be omitted.

The timing controller 130 may transmit the pixel data of the input image to the data driver 110 and may synchronize the data driver 110, the demultiplexer 112, and the gate driver 120. The timing controller 130 may include a data operator that is configured to receive sensing data obtained from the pixels P in the display panel driver to which the external compensation technology is applied and to modulate the pixel data. In this case, the timing controller 130 may transmit the pixel data modulated by the data operator to the data driver 110.

The timing controller 130 may control the operation timing of the display panel drivers 110, 112, and 120 at a frame frequency of an input frame frequency×i Hz (i is a positive integer greater than 0) by multiplying the input frame frequency by i. The input frame frequency is 60 Hz in the National Television Standards Committee (NTSC) scheme and 50 Hz in the Phase-Alternating Line (PAL) scheme. The timing controller 130 may lower the frame frequency to a frequency between 1 Hz and 30 Hz to lower the refresh rate of the pixels P in the low-speed driving mode.

The timing controller 130 may generate a data timing control signal for controlling the operation timing of the data driver 110, a switch control signal for controlling the operation timing of the demultiplexer 112, and a gate timing control signal for controlling the operation timing of the gate driver 120 based on the timing signals Vsync, Hsync, and DE received from the host system.

The gate timing signal may include a start pulse, a shift clock, etc. A voltage level of the gate timing control signal output from the timing controller 130 may be converted into a gate high voltage VGH/VEH and a gate low voltage VGL/VEL through a level shifter (not illustrated in the drawings) and be supplied to the gate driver 120. The level shifter may convert a low level voltage of the gate timing control signal into the gate low voltage VGL/VEL and convert a high level voltage of the gate timing control signal into the gate high voltage VGH/VEH.

The power supply unit 150 may include a charge pump, a regulator, a buck converter, a boost converter, the gamma voltage generating circuit, etc. The power supply unit 150 may generate a DC voltage required to drive the display panel driver and the display panel 100 by adjusting a DC input voltage from the host system. The power supply unit 150 may output DC voltages, such as a gamma reference voltage, the gate-off voltage VGH/VEH, the gate-on voltage VGL/VEL, a pixel driving voltage ELVDD, a low-potential power voltage ELVSS, an initialization voltage Vini, and a reference voltage VREF.

The gamma voltage generating circuit may be implemented as a programmable gamma IC (P-GMA IC). The programmable gamma IC may vary the gamma voltage according to a register setting value. The gamma voltage may be supplied to the data driver 110. The gate-off voltage VGH/VEH and the gate-on voltage VGL/VEL may be supplied to the level shifter and the gate driver 120. The pixel driving voltage ELVDD, the low potential power voltage ELVSS, the initialization voltage Vini, and the reference voltage VREF may be commonly supplied to the pixel circuits through power lines. The pixel driving voltage ELVDD may be set to a voltage higher than the low potential power voltage ELVSS, the initialization voltage Vini, and the reference voltage VREF.

Figure 10:
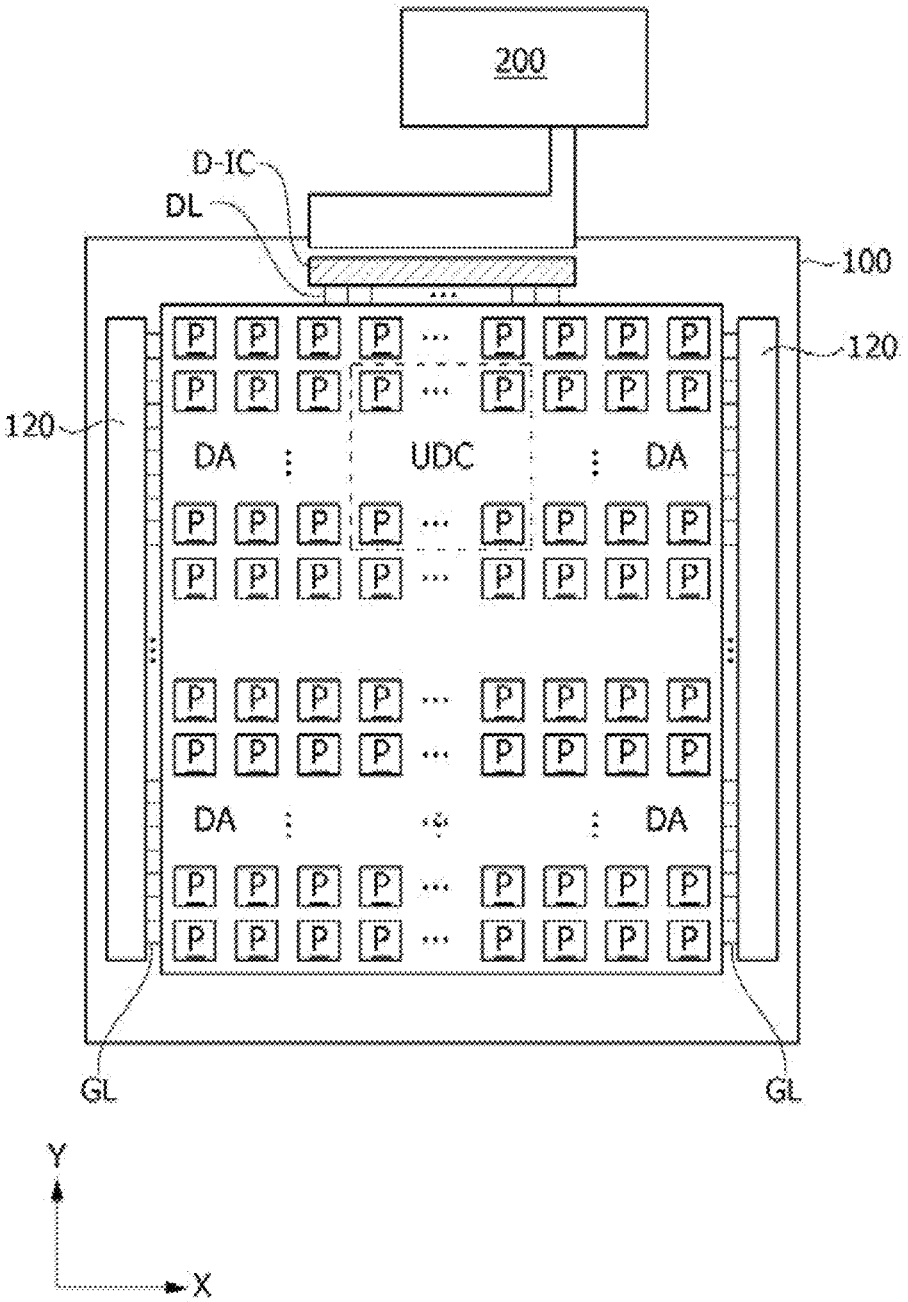
FIG. 10 is a view illustrating an example in which the display device according to an example embodiment of the present disclosure is applied to a mobile device.

The host system may be a main circuit board of a TV (Television) system, a set-top box, a navigation system, a personal computer (PC), a vehicle system, a home theater system, a mobile device, or a wearable device, but the present disclosure is not limited thereto. In the mobile device or wearable device, the timing controller 130, the data driver 110, and the power supply unit 150 may be integrated into one drive integrated circuit (Drive IC, D-IC) as shown in FIG. 10. In FIG. 10, reference numeral 200 denotes the host system.

The grayscale voltage of pixel data and the luminance of the pixels may be changed by an analog voltage level of a data voltage Vdata applied to a driving element DT. The analog voltage level of the data voltage Vdata may be determined according to a gamma voltage output from the gamma voltage generating circuit. The gamma voltage may be set as an inverse gamma curve or a positive gamma curve according to a structure of the pixel circuit.

For example, if the data voltage Vdata is applied to a gate electrode of an n-channel type driving element DT implemented with an n-channel transistor, a gate-source voltage Vgs of the driving element DT may be proportional to the data voltage Vdata, so that the gamma voltage is set as an analog voltage defined by the positive gamma curve. Conversely, if the data voltage Vdata is applied to a first electrode or a second electrode of the n-channel type driving element DT, the gate-source voltage Vgs of the driving element DT may be inversely proportional to the data voltage Vdata, so that the gamma voltage is set as an analog voltage defined by the inverse gamma curve.

If the data voltage Vdata is applied to a gate electrode of a p-channel type driving element DT implemented with a p-channel transistor, the gate-source voltage Vgs of the driving element DT may be inversely proportional to the data voltage Vdata, so that the gamma voltage is set as an analog voltage defined by the inverse gamma curve. Conversely, if the data voltage Vdata is applied to a first electrode or a second electrode of the p-channel type driving element DT, the gate-source voltage Vgs of the driving element DT may be proportional to the data voltage Vdata, so that the gamma voltage is set as an analog voltage defined by the positive gamma curve.

Figure 11:
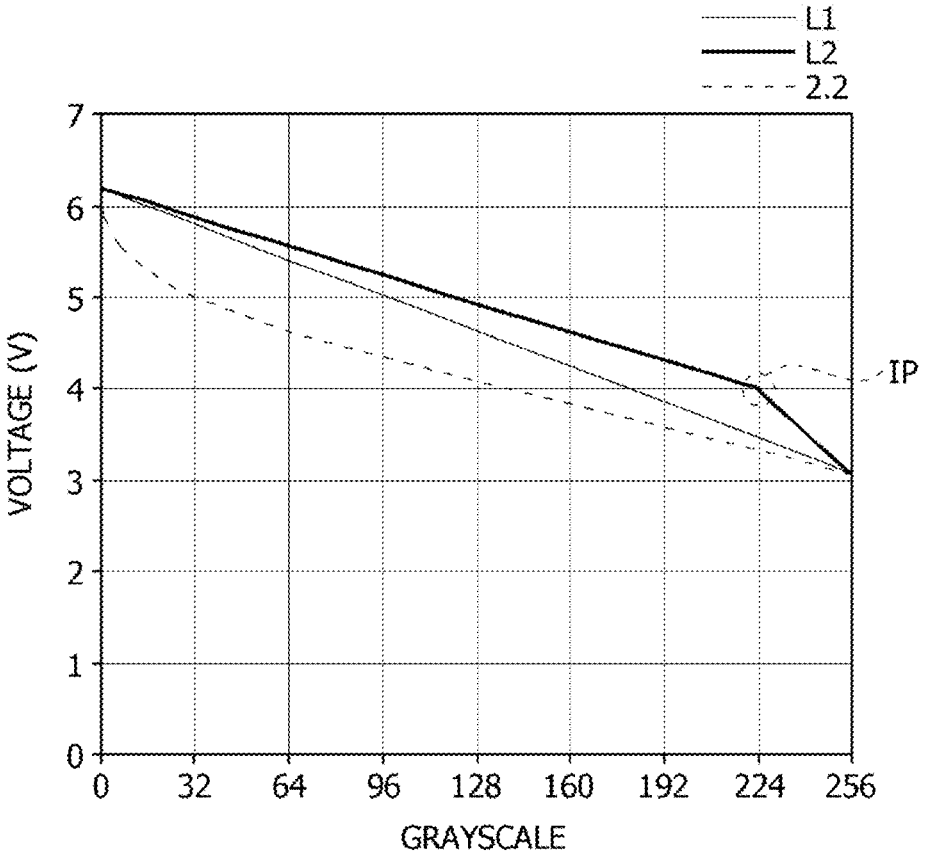
FIG. 11 is a view illustrating an example in which a bilinear gamma curve according to an example embodiment of the present disclosure and comparative examples are applied as an inverse gamma curve.
Figure 12:
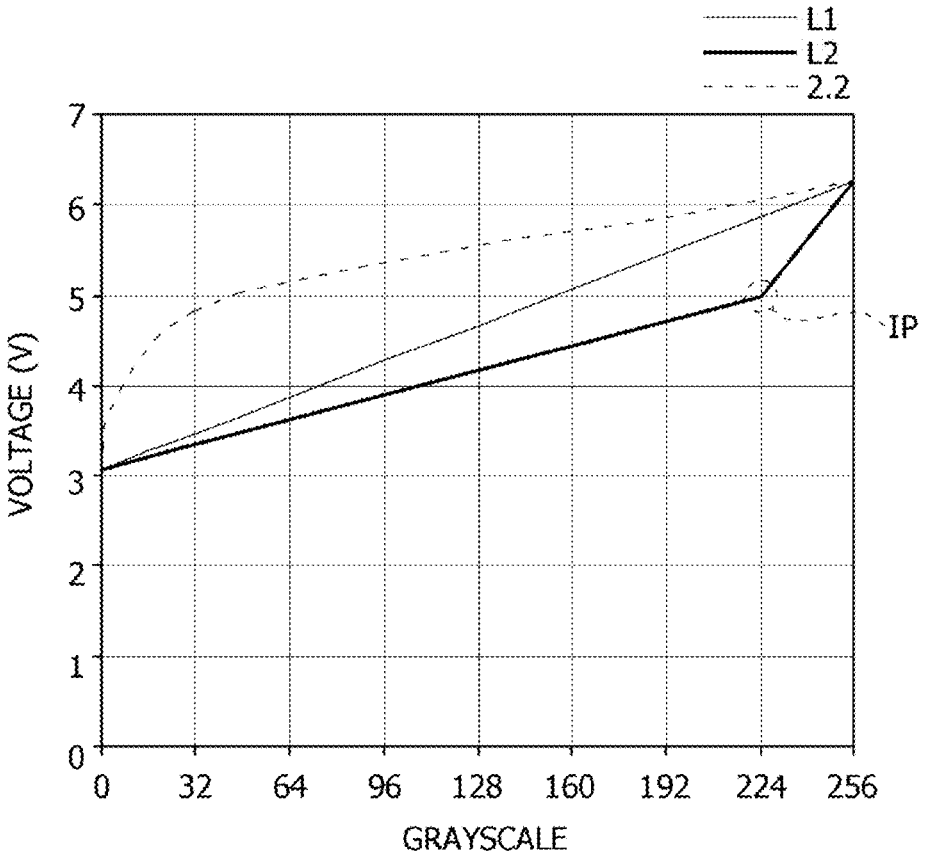
FIG. 12 is a view illustrating an example in which a bilinear gamma curve according to an example embodiment of the present disclosure and comparative examples are applied as a positive gamma curve.

FIG. 11 is a view illustrating an example inverse gamma curve. FIG. 12 is a view illustrating an example positive gamma curve. In FIGS. 11 and 12, horizontal axes represent the grayscale of pixel data, and vertical axes represent a voltage V. The inverse gamma curve defines a gamma voltage inversely proportional to the grayscale of the pixel data. The positive gamma curve defines a gamma voltage proportional to the grayscale of the pixel data.

The gamma voltage generating circuit of example embodiments of the present disclosure may output gamma voltages defined by a bilinear gamma curve L2. The bilinear gamma curve L2 may include a first linear section and a second linear section having a greater slope than the first linear section. The first linear section and the second linear section may be connected at an inflection point IP. The first linear section may define a total grayscale voltage of the pixel data to be written to the pixels of the first pixel area DA and may define voltages of approximately 80% to 90% of a grayscale section including a low grayscale and a middle grayscale among all grayscales of the pixel data to be written to the pixels of the second pixel area UDC. The second linear section may define high luminance voltages of approximately 10% to 20% of a grayscale section including a high grayscale to be written to the pixels of the second pixel area UDC.

The bilinear gamma curve L2 can improve image quality by expressing the grayscale of the pixel data in detail by expanding the driving range (or dynamic range) of the first pixel area DA compared to a first comparative example (illustrated as a dashed line 2.2) set as a 2.2 gamma curve and a second comparative example (illustrated as L1) set as a single linear gamma curve. The bilinear gamma curve (illustrated as L2) may increase the digital gamma resolution of the pixel data to be written to the pixels of the first pixel area DA, compared to the first and second comparative examples (respectively illustrated as 2.2 and L1), and may reduce the number of bits required for digital gamma correction for optical compensation. Accordingly, the bilinear gamma curve L2 can improve image quality since the grayscale of the pixel data can be more precisely reproduced by expanding the driving range of the first pixel area DA in which most of the image is reproduced. Also, the bilinear gamma curve L2 may simplify hardware resources to implement the digital gamma correction circuit since the number of bits required at the time of digital gamma correction is reduced.

The bilinear gamma curve L2 may include the inflection point IP where the first linear section and the second linear section meet. The inflection point IP may be set as a peak white grayscale (or the uppermost grayscale) voltage of the pixel data to be written to the pixels of the first pixel area DA. The position of the inflection point IP may be changed when the PPI of the second pixel area UDC is changed.

Figure 13:
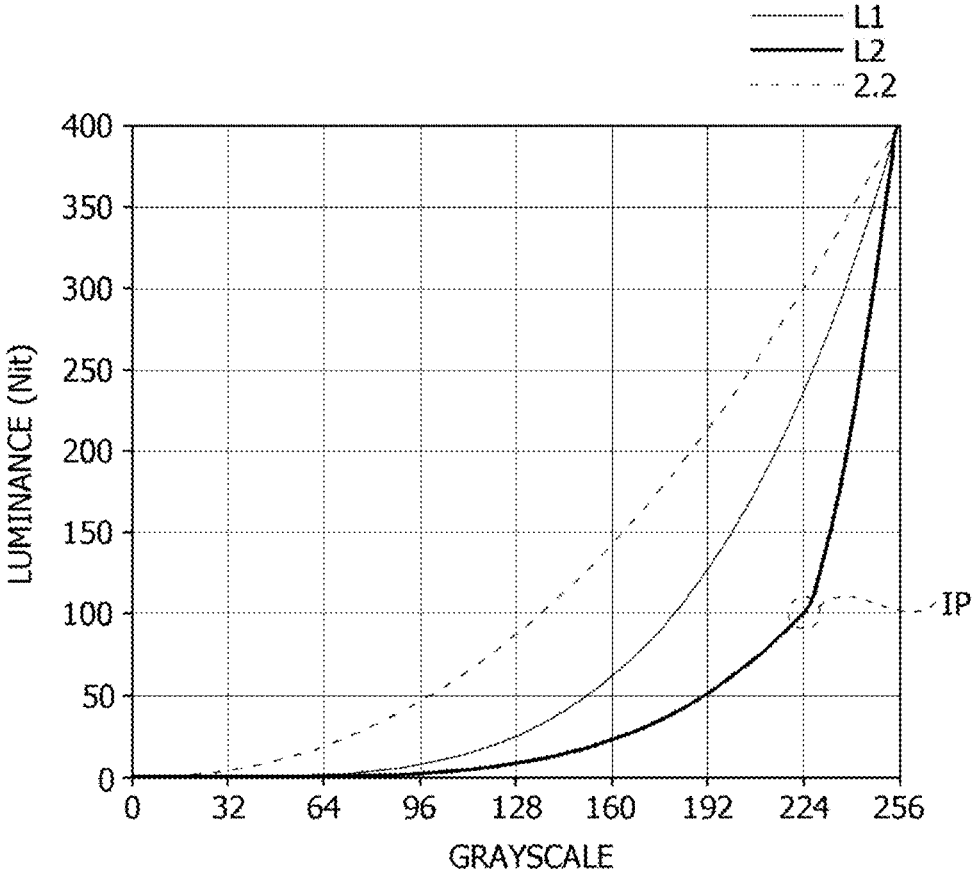
FIG. 13 is a view illustrating luminance characteristics of pixels when voltages defined by a gamma curve according to an example embodiment of the present disclosure and comparative examples are charged to the pixels.

FIG. 13 is a view illustrating luminance characteristics of pixels when voltages defined by the gamma curve L2 according to an example embodiment of the present disclosure and the comparative examples 2.2 and L1 are charged to the pixels. In FIG. 13, a horizontal axis represents the grayscale of the pixel data, and a vertical axis represents luminance Nit. An inflection point may be generated in a luminance characteristic curve of the pixels by the inflection point IP of the gamma curve. As shown in the FIG. 13 example, the gamma curve L2 may include two distinct curved sections meeting at the inflection point IP.

Figure 14:
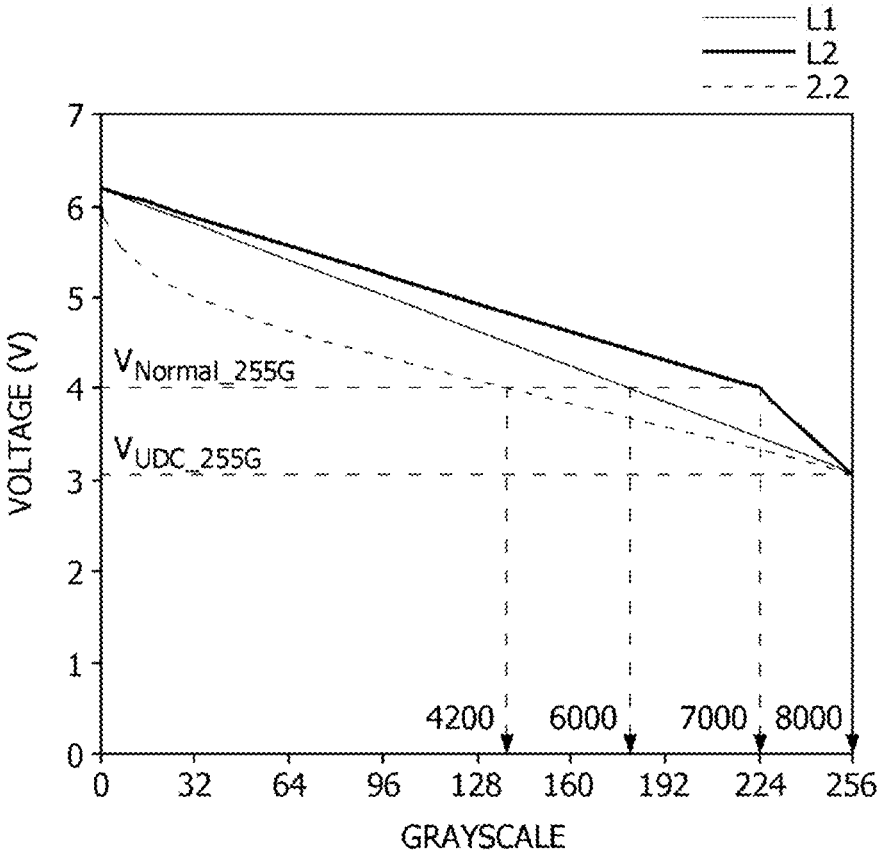
FIGS. 14 and 15 are views illustrating simulation results of comparing an allocable digital gamma range in a bilinear gamma curve according to an example embodiment of the present disclosure and comparative examples.
Figure 15:
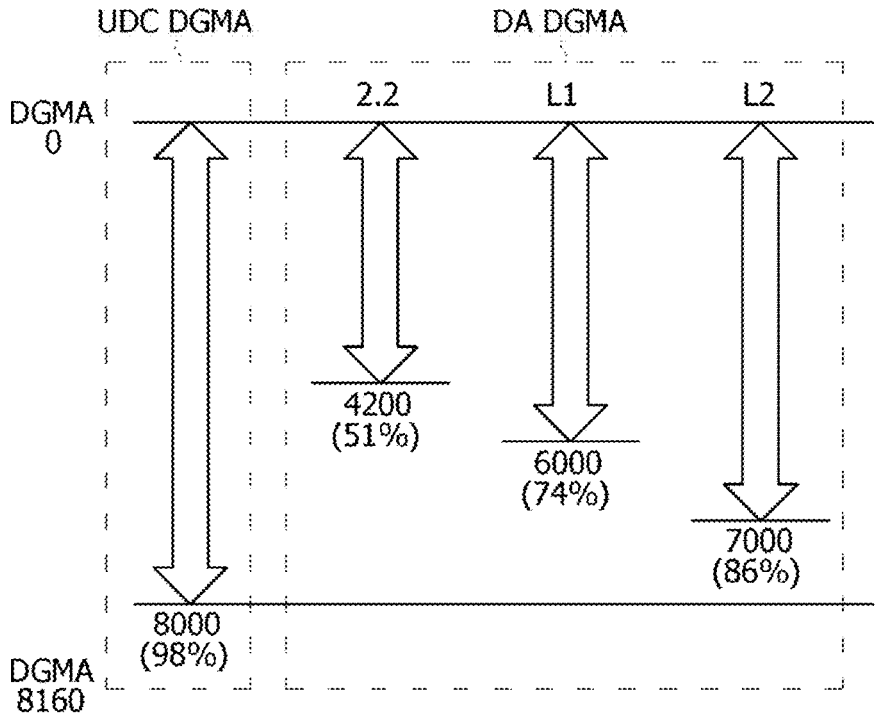

A digital gamma range ratio of the first pixel area DA and the second pixel area UDC may be changed according to an analog gamma voltage output from the gamma voltage generating circuit, that is, a gamma voltage. With respect to the digital gamma range allocable to the first pixel area DA in the bilinear gamma curve L2 in comparison to the comparative examples 2.2 and L1, as shown in FIGS. 14 and 15, approximately 51% of the entire grayscale voltage range in the first comparative example 2.2, 74% of the entire grayscale voltage range in the second comparative example L1, and 86% of the entire grayscale voltage range in the bilinear gamma curve L2 may be assigned as the digital gamma range in the first pixel area DA. Accordingly, the bilinear gamma curve L2 may secure a wider driving range of the first pixel area DA compared to the comparative examples and may secure a wider digital gamma resolution by that amount. Thus, the resolution of the pixel data, that is, the number of expressible grayscales, may be sufficiently secured without expanding the number of bits of the pixel data.

In FIG. 14, "$V_{NORMAL_255G}$" is an analog voltage of grayscale 224 representing the maximum luminance of the first pixel area DA. "$V_{UDC_255G}$" is an analog voltage of grayscale 256 representing the maximum luminance of the second pixel area UDC. 4200 to 8000 indicate a decimal grayscale value when the pixel data is 13-bit.

In FIG. 15, "UDC DGMA" is a digital gamma range for pixel data to be written to pixels of the second pixel area UDC, and "DA DGMA" is a digital gamma range for pixel data to be written to pixels of the first pixel area DA. "DGMA 0" is a 13-bit digital value of the lowest grayscale 0 of pixel data, and "DGMA 8160" is a 13-bit digital value of grayscale 256 representing the maximum luminance of the second pixel area UDC.

Figure 16:
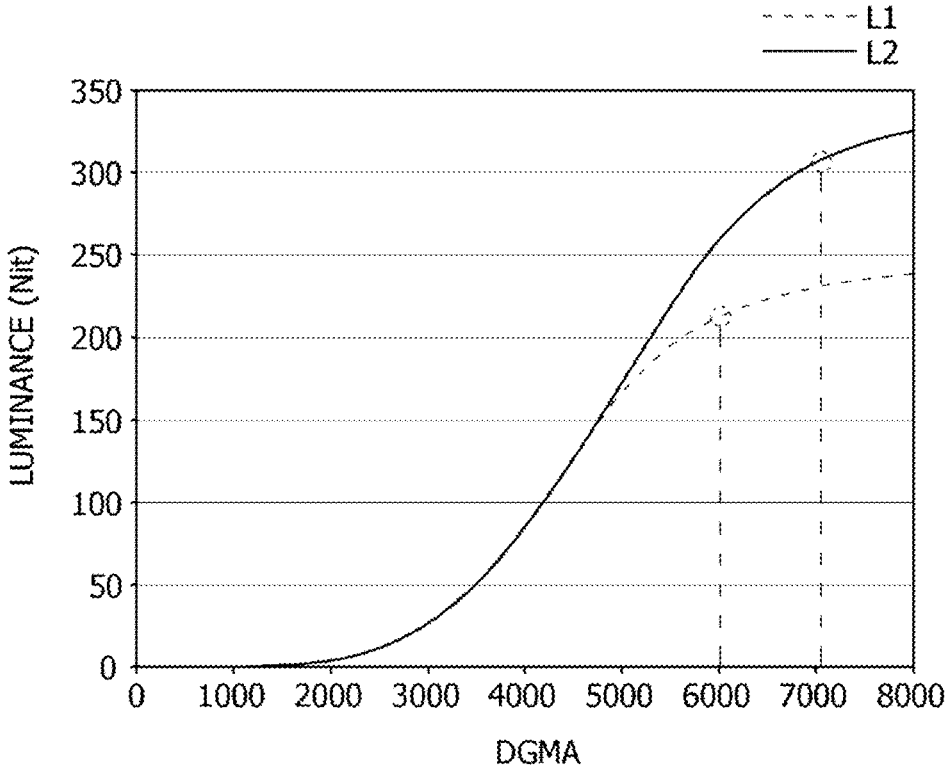
FIG. 16 is a view comparing the luminance of a second comparative example and a bilinear gamma curve according to an example embodiment of the present disclosure.

FIG. 16 is a view comparing the luminance of the second comparative example L1 and the bilinear gamma curve L2. As shown in FIGS. 15 and 16, when the digital gamma range of the first pixel area DA increases to 80% or more, since most of the entire grayscale range set based on the second pixel area UDC may be used for gamma correction, detailed grayscale expression is possible in the first pixel area DA, so that image quality is improved. Moreover, the luminance change according to the change of the pixel data may become similar in the first pixel area DA and the second pixel area UDC, and the difference in luminance and color deviation between the first pixel area DA and the second pixel area UDC may be reduced. Thus, more uniform image quality can be realized over the entire screen.

When the digital gamma range is widened, the grayscale expressiveness of the pixel data may be improved. Thus, when optical compensation performance is improved, an optical compensation process time may be reduced. When the digital gamma correction for optical compensation of the second pixel area UDC is calculated after driving the pixels with the voltage defined by the 2.2 gamma curve of the first comparative example 2.2, only about 50% of the digital gamma range may be used for optical compensation. Accordingly, in the case of the 2.2 gamma curve of the first comparative example 2.2, the data range may be doubled by increasing the number of bits of the digital gamma correction circuit. In the case of the single linear gamma curve of the second comparative example L1, when the number of bits is reduced by one bit, the data resolution may be reduced by about 30%, so that the image quality degradation can be recognized. Accordingly, in the first and second comparative examples 2.2 and L1, it is difficult to reduce the number of data bits of the digital gamma correction circuit for optical compensation.

In the case of the gamma curve of example embodiments of the present disclosure, although data resolution degradation of about 10% may occur, the number of data bits of the digital gamma correction circuit can be reduced because the image quality degradation may be too small to be recognized. Accordingly, when the pixels are driven by applying the example gamma curves of the present disclosure, including the bilinear gamma curve, digital gamma correction operation may be performed without extending the number of bits in the data.

Figure 17:
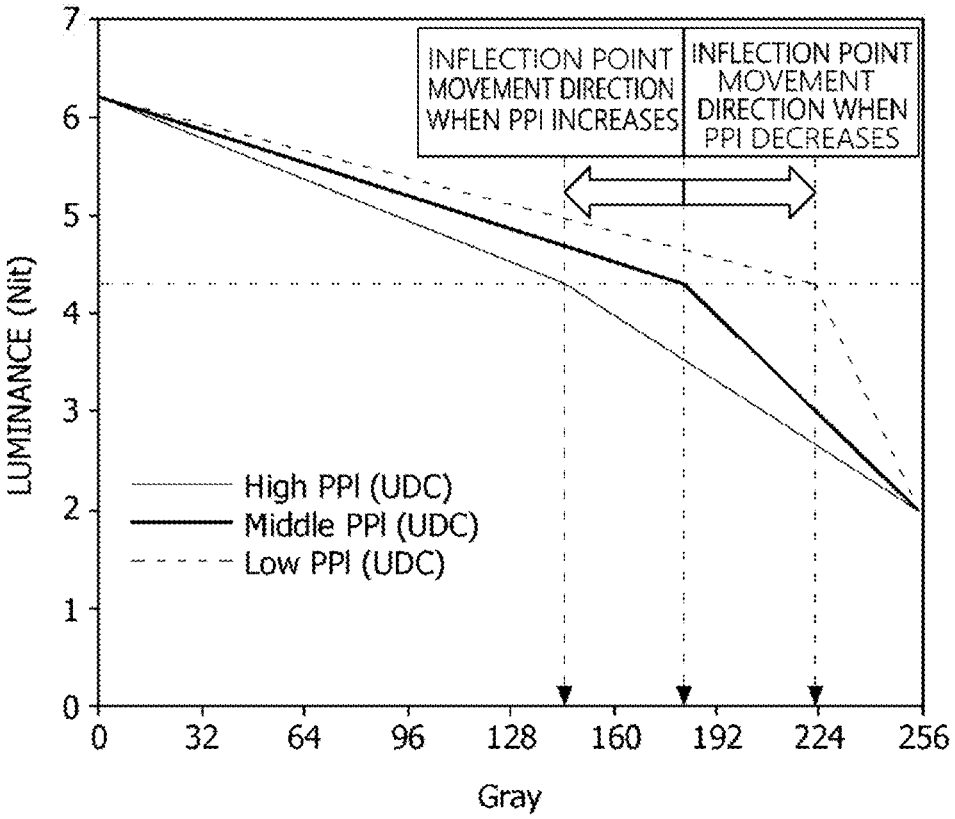
FIG. 17 is a view illustrating an example in which an inflection point of a bilinear gamma curve is changed according to a pixels-per-inch (PPI) of a second pixel area.

FIG. 17 is a view illustrating an example in which the inflection point of the bilinear gamma curve is changed according to a pixels-per-inch (PPI) of the second pixel area. In FIG. 17, "UDC" is the second pixel area.

A current $I_{OLED}$ flowing through the light emitting element EL may be proportional to the gate-source voltage Vgs of the driving element DT as shown in the following equation.

$$I_{OLED} = \frac{1}{2} \cdot \mu \cdot C_{ox} \cdot \frac{W}{L}(Vgs - Vth)^2$$

Here, μ is current mobility of the driving element DT, and $C_{ox}$ is channel capacitance of the driving element DT. W is a channel width of the driving element DT, and L is a channel length of the driving element DT.

When the PPI of the second pixel area UDC decreases, a current flowing per sub-pixel of the second pixel area UDC increases. Accordingly, as the PPI of the second pixel area UDC decreases, the pixel driving voltage of the second pixel area UDC may become lower in an inverse gamma reference, and an analog reference voltage, that is, the gamma voltage, may become lower. In this case, since the driving range of the first pixel area is reduced compared to the entire grayscale range, the inflection point IP of the bilinear gamma curve L2 may be shifted to the right as shown in FIG. 17, so that data resolution in the first pixel area DA can be increased. Conversely, as the PPI of the second pixel area UDC increases, the inflection point IP of the bilinear gamma curve L2 may be shifted to the left.

Figure 18:
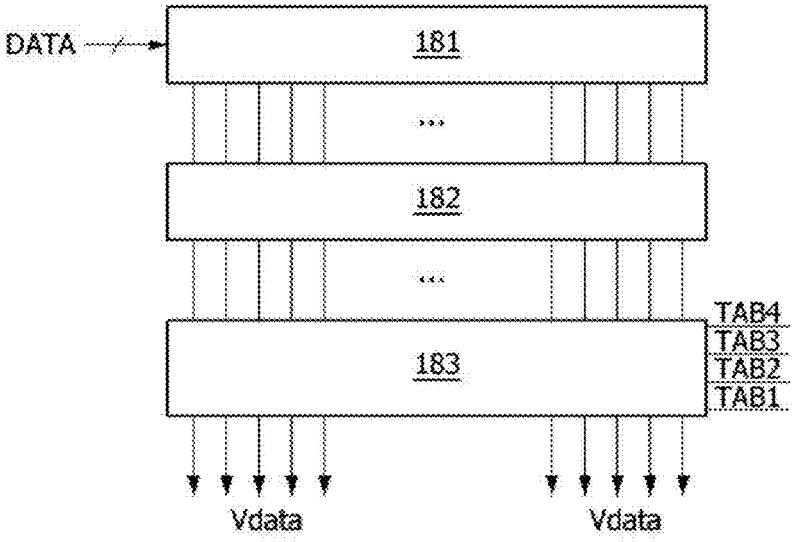
FIG. 18 is a view illustrating an example configuration of a data driver.

FIG. 18 is a view illustrating an example configuration of a data driver 110.

As shown in FIG. 18, the data driver 110 may include a serial-to-parallel converter 181, a digital-to-analog converter (DAC) 182, and an output circuit 183.

The serial-to-parallel converter 181 may sample pixel data DATA received from a timing controller 130 and convert the pixel data into parallel data. The serial-to-parallel converter 181 may include a shift register and a latch. The latch may convert serial data into parallel data by sequentially latching the pixel data DATA received as the serial data from the timing controller 130 and outputting at the same time.

The DAC 182 may output a data voltage Vdata by converting the pixel data DATA input from the serial-to-parallel converter 181 into gamma voltages TAB1 to TAB4 from the gamma voltage generating circuit. The data voltage Vdata may be transmitted to data lines DL through the output circuit 183 and a demultiplexer array 112 or may be directly supplied to the data lines DL through the output circuit 183. The output circuit 183 may output the data voltage through an output buffer AMP connected to an output node of the DAC 182 for each channel of the data driver 110. Meanwhile, the gamma voltages TAB1 to TAB4 may be divided through a voltage dividing circuit (not illustrated) and be supplied to the DAC 182, but the present disclosure is not limited thereto.

Figure 19:
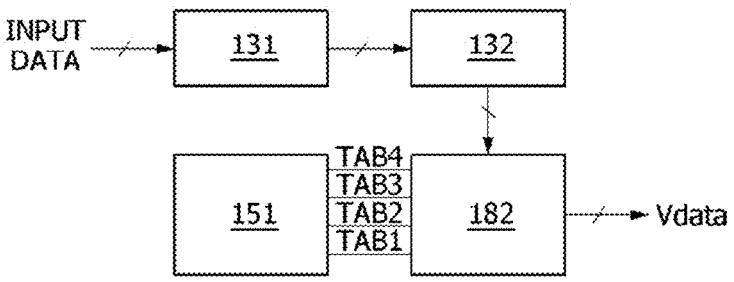
FIG. 19 is a view illustrating a digital gamma correction circuit and a gamma voltage generating circuit.

FIG. 19 is a view illustrating an example digital gamma correction circuit and an example gamma voltage generating circuit.

As shown in FIG. 19, the display device according to example embodiments of the present disclosure may include a bit expansion circuit 131, a digital gamma correction circuit 132, and a gamma voltage generating circuit 151.

The bit expansion circuit 131 may receive pixel data of an input image and expand bits of the data. For example, the bit expansion circuit 131 may convert 8-bit data into 13-bit data by adding a bit for digital gamma correction. When the bilinear gamma curve according to example embodiments of the present disclosure is applied, the number of additional bits of data may be reduced or additional bits of data may not be necessary. Accordingly, the bit expansion circuit 131 may be omitted.

The timing controller 130 may perform frame rate control (FRC) by adding the number of bits to pixel data in order to more precisely express the grayscale of pixels. In this case, the bit expansion circuit 131 may include an FRC circuit.

The digital gamma correction circuit 132 may calculate a compensation value derived for optical compensation of the pixel data on the pixel data. The pixel data modulated by the digital gamma correction circuit 132 may be input to the DAC 182 of the data driver 110. Data output from the digital gamma correction circuit 132 may be transmitted to the data driver 110 and be input to the DAC 182 through the serial-to-parallel converter 181.

The bit expansion circuit 131 and the digital gamma correction circuit 132 may be integrated in the timing controller 130.

The gamma voltage generating circuit 151 may output the first to the fourth gamma voltages TAB1 to TAB4 corresponding to a lowest grayscale voltage (or black grayscale voltage) of the bilinear gamma curve L2, a first grayscale voltage, a maximum luminance voltage (or inflection point voltage) of the first pixel area DA, and a maximum luminance voltage of the second pixel area UDC, respectively. The gamma voltage generating circuit 151 may include a first output terminal through which the first gamma voltage TAB1 may be output, a second output terminal through which the second gamma voltage TAB2 may be output, a third output terminal through which the third gamma voltage TAB3 may be output, and a fourth output terminal through which the fourth gamma voltage TAB4 may be output.

The first gamma voltage TAB1 may be a black grayscale voltage of the bilinear gamma curve L2, that is, a voltage of grayscale 0 (zero). The second gamma voltage TAB2 may be a low grayscale voltage between the black grayscale voltage and the inflection point voltage in the bilinear gamma curve L2. The second gamma voltage TAB2 may be set to the higher grayscale of the black grayscale of the pixels disposed in the first and second pixel areas DA and UDC, for example, a voltage of grayscale 1. The third gamma voltage TAB3 may be the maximum luminance voltage of the first pixel area DA corresponding to the inflection point IP of the bilinear gamma curve L2, that is, a voltage of the highest grayscale of 255. The fourth gamma voltage TAB4 may be the maximum luminance voltage of the second pixel area UDC in the bilinear gamma curve L2, that is, the voltage of the highest grayscale of 255.

The first section of the bilinear or bi-section gamma curve L2 may be a linear (see, e.g., FIGS. 12, 14, and 17) or curved (see, e.g., FIG. 13) voltage section between the first gamma voltage TAB1 and the third gamma voltage TAB3. The second section of the bilinear or bi-section gamma curve L2 may be a linear or curved voltage section between the third gamma voltage TAB3 and the fourth gamma voltage TAB4.

Figure 20:
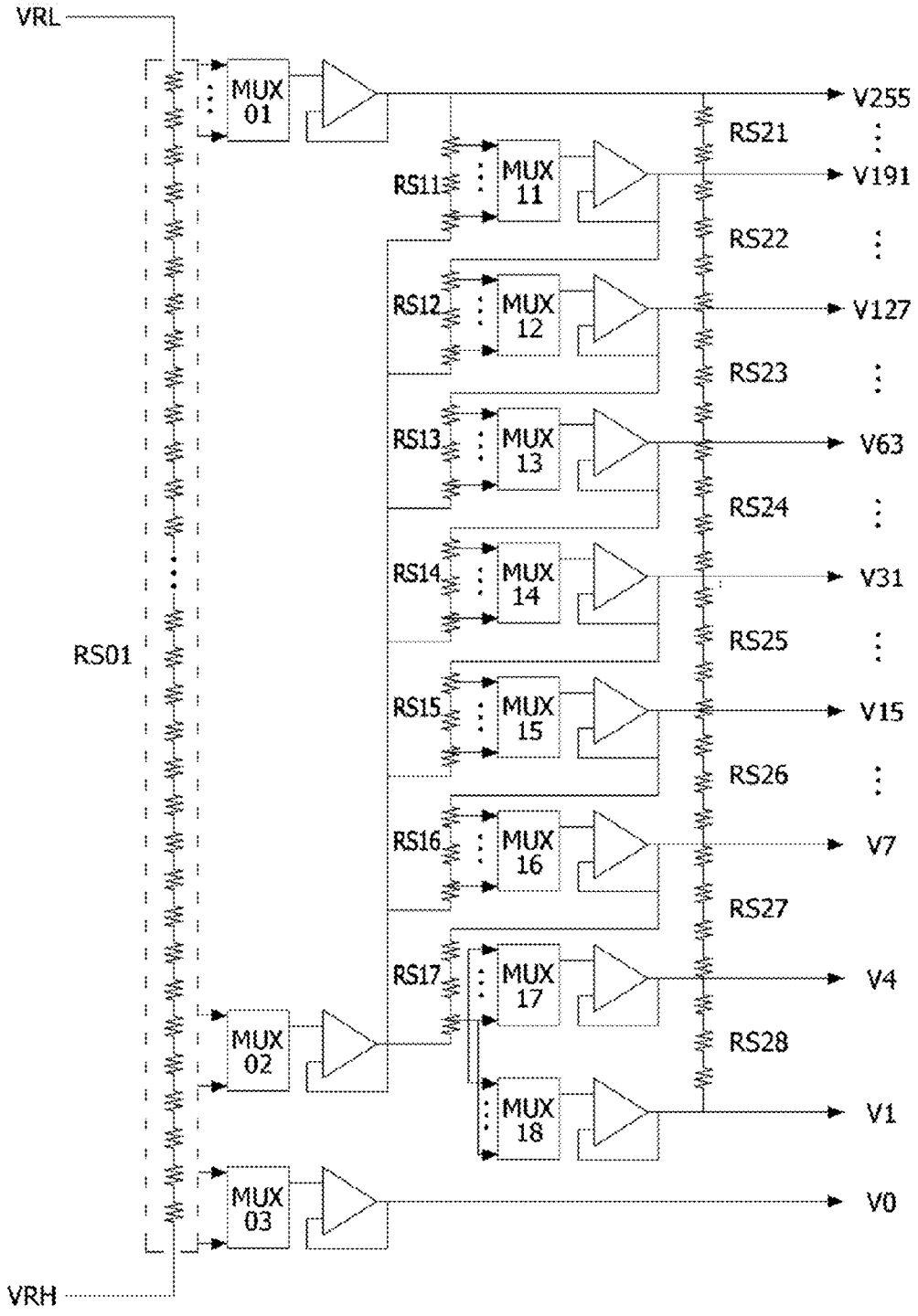
FIG. 20 is a circuit diagram illustrating a gamma voltage generating circuit of a first comparative example.

FIG. 20 is a circuit diagram illustrating the gamma voltage generating circuit for outputting a gamma curve voltage of the first comparative example 2.2.

As shown in FIG. 20, the gamma voltage generating circuit of the first comparative example may include a plurality of voltage dividing circuits RS01, RS11 to RS17, and RS21 to RS28, and a plurality of multiplexers MUX01 to MUX03, and MUX11 to MUX18, and may output gamma voltages defined by the 2.2 gamma curve. An output node of each of the multiplexers MUX01 to MUX03, and MUX11 to MUX18 may be connected to a buffer.

The voltage dividing circuits RS01, RS11 to RS17, and RS21 to RS28 may output voltages having different voltage levels using series-connected resistors. Each of the multiplexers MUX01 to MUX03 and MUX11 to MUX18 may select a voltage indicated by a resistor setting value from input voltages having different voltage levels.

The gamma voltage generating circuit of the first comparative example may output a black grayscale voltage V0 and a plurality of gamma voltages V0 to V255 corresponding to each grayscale voltage. V0 is a black grayscale voltage, V1 is a gamma voltage corresponding to grayscale 1, and so on. V255 is a gamma voltage corresponding to grayscale 255.

In the case of the gamma voltage generating circuit of the first comparative example, a voltage dividing circuit, a multiplexer, a buffer, etc., may be added to add a gamma voltage for driving a low-resolution pixel area with high luminance in order to increase the luminance of a low-resolution second pixel area.

The gamma voltage generating circuit according to an example embodiment of the present disclosure may output the first to the fourth gamma voltages TAB1 to TAB4 defined by the bilinear gamma curve L2.

Figure 21:
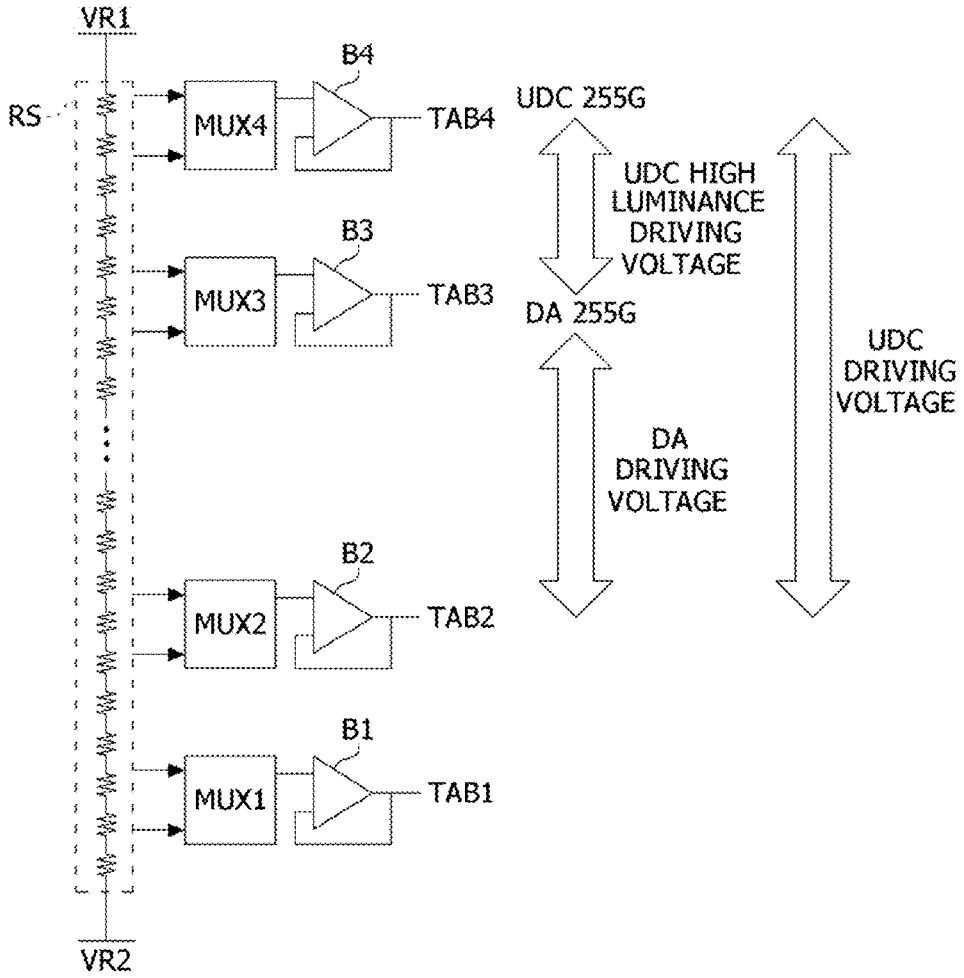
FIGS. 21 and 22 are circuit diagrams illustrating a gamma voltage generating circuit according to an example embodiment of the present disclosure.
Figure 22:
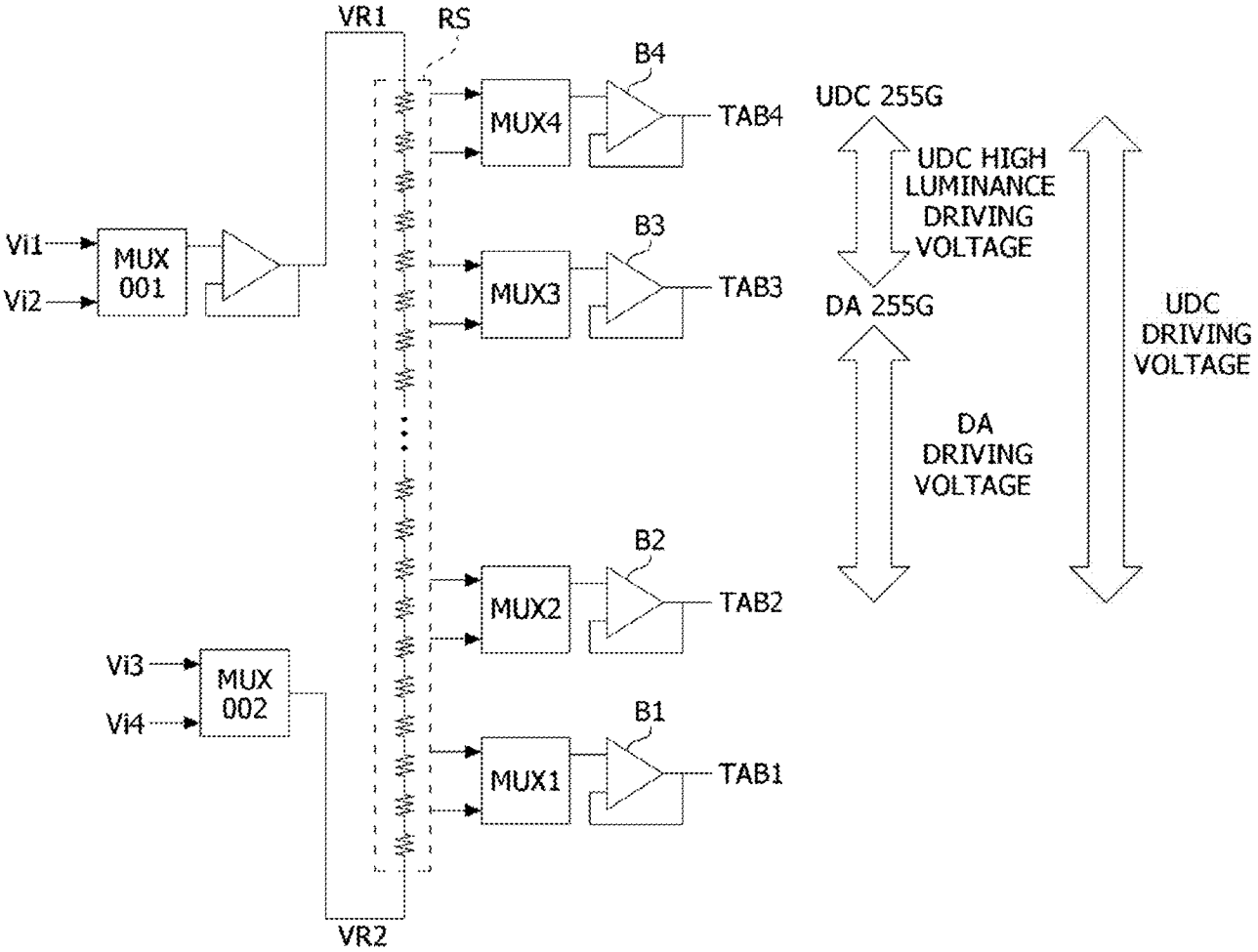

FIGS. 21 and 22 are circuit diagrams illustrating the gamma voltage generating circuit 151 configured to output a bilinear gamma curve voltage according to an example embodiment of the present disclosure.

As shown in FIGS. 21 and 22, the gamma voltage generating circuit 151 according to an example embodiment of the present disclosure may include a voltage dividing circuit RS to which a first reference voltage VR1 and a second reference voltage VR2 may be applied, and first to fourth multiplexers MUX1 to MUX4 connected to the voltage dividing circuit RS.

The first reference voltage VR1 may be applied to one end of the voltage dividing circuit RS, and the second reference voltage VR2 may be applied to the other end of the voltage dividing circuit RS. The first reference voltage VR1 may be a lower voltage than the second reference voltage VR2 in the inverse gamma curve and may be a higher voltage than the second reference voltage VR2 in the positive gamma curve.

The voltage dividing circuit RS may include resistors connected in series and voltage dividing nodes between adjacent resistors. Different voltages may be output between the first reference voltage VR1 and the second reference voltage VR2 at the voltage dividing nodes of the voltage dividing circuit RS.

The voltages of the first reference voltage VR1 and the second reference voltage VR2 may be changed by an input voltage selection circuit, but the present disclosure is not limited thereto. The input voltage selection circuit may be omitted. As shown in FIG. 22, the input voltage selection circuit may include a multiplexer MUX001 that may select either one of a first input voltage Vi1 and a second input voltage Vi2 according to a register setting value, and a multiplexer MUX002 that may select either one of a third input voltages Vi3 and a fourth input voltage Vi4 according to the register setting value. The first reference voltage VR1 output from the multiplexer MUX001 may be applied to one end of the voltage dividing circuit RS through the buffer. The second reference voltage VR2 output from the multiplexer MUX002 may be applied to the other end of the voltage dividing circuit RS.

The first to the fourth multiplexers MUX1 to MUX4 may be connected to the voltage dividing nodes of the voltage dividing circuit RS, respectively, and may each select and output any one of the voltages of the voltage dividing nodes according to a register setting value. The register setting value may be a memory connected to the timing controller 130, for example, an electrically erasable programmable read-only memory (EEPROM) or a flash memory. When the register setting value is changed, the voltages output from the multiplexers MUX001 and MUX002 and MUX1 to MUX4 may be changed.

The first multiplexer MUX1 may output the black grayscale voltage TAB1 selected according to a first register setting value. The second multiplexer MUX2 may output a higher grayscale of the black grayscale selected according to a second register setting value, for example, the voltage TAB2 of grayscale 1. The third multiplexer MUX3 may output a highest grayscale voltage of the first pixel area DA selected according to a third register setting value. The fourth multiplexer MUX4 may output a highest grayscale voltage TAB4 of grayscale 255 of the second pixel area UDC selected according to a fourth register setting value. The output voltage of each of the multiplexers MUX1 to MUX4 may be supplied to the DAC 182 through buffers B1 to B4, respectively.

The light emitting element EL of the pixels may be driven from grayscale 1 and may emit light. From the viewpoint of driving the light emitting element EL, the pixels disposed in the first pixel area DA may be driven in a driving voltage range between the second gamma voltage TAB2 and the third gamma voltage TAB3. The pixels disposed in the second pixel area UDC may be driven in a driving voltage range between the second gamma voltage TAB2 and the fourth gamma voltage TAB4. The high luminance driving voltage ranges of the pixels disposed in the second pixel area UDC may be from the third driving voltage TAB3 to the fourth driving voltage TAB4 exceeding the driving voltage of the pixels in the first pixel area DA.

As can be seen from the comparison of FIG. 20 and FIG. 21, the gamma voltage generating circuit according to example embodiments of the present disclosure may not need the voltage dividing circuits RS21 to RS28, and the multiplexers MUX11 to MUX18 respectively connected to the output nodes of the voltage dividing circuits RS21 to RS28, as shown in FIG. 20. Accordingly, since the circuit configuration of the gamma voltage generating circuit according to an example embodiment of the present disclosure may be simplified compared to the gamma voltage generating circuit of the first comparative example, the size of the circuit may be reduced, in some embodiments by more than half.

In the present disclosure, since sensors may be disposed on a screen on which an image may be displayed, a full screen display can be implemented.

In the present disclosure, pixels may be driven using a gamma voltage defined by a bilinear gamma curve including the first linear or curved section defining a pixel driving voltage range of a high pixels per inch (PPI) disposed in the first pixel area, and the second linear or curved section defining a high luminance pixel driving voltage range of a low PPI disposed in the second pixel area. The bilinear gamma curve can secure a sufficient driving range of the first pixel area and secure the data resolution of digital gamma to enable detailed grayscale expression, and can improve image quality and optical compensation performance by minimizing the difference in luminance and color deviation between the first and second pixel areas.

According to example embodiments of the present disclosure, the number of bits used for digital gamma correction may be reduced by using the bilinear gamma curve, and the number of taps of the gamma voltage generating circuit can be reduced, so that the size of the gamma voltage generating circuit can be reduced.

In the present disclosure, the luminance deviation of sub-pixels can be optically compensated with high resolution by securing a voltage margin without extending the voltage range of the data voltage applied to the pixels of the low resolution or low PPI area, so that the precision of optical compensation can be improved, and a data voltage variable range for compensating for image quality upon changes with the passage of time can be secured.

The effects of the present disclosure are not limited to the above-mentioned effects, and other effects that are not mentioned will be apparent to those skilled in the art from the above description and the appended claims.

The objects to be achieved by the present disclosure, the means for achieving the objects, and effects of the present disclosure described above do not specify essential features of the claims. Thus, the scope of the claims is not limited to the disclosure of example embodiments of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A gamma voltage generating circuit for use in a display device having a first pixel area and a second pixel area, the gamma voltage generating circuit comprising:

a voltage dividing circuit configured to receive a first reference voltage and a second reference voltage at two respective ends and to provide voltages having different voltage levels between the first reference voltage and the second reference voltage through voltage dividing nodes between the two ends;

a first multiplexer configured to output a voltage selected according to a first resistor setting value from the voltages provided by the voltage dividing circuit as a first gamma voltage;

a first output terminal to output the first gamma voltage set as a black grayscale voltage;

a second multiplexer configured to output a voltage selected according to a second resistor setting value from the voltages provided by the voltage dividing circuit as a second gamma voltage;

a second output terminal to output the second gamma voltage set as a higher grayscale voltage than the black grayscale voltage;

a third multiplexer configured to output a voltage selected according to a third resistor setting value from the voltages provided by the voltage dividing circuit as a third gamma voltage;

a third output terminal to output the third gamma voltage set as a highest grayscale voltage of the first pixel area;

a fourth multiplexer configured to output a voltage selected according to a fourth resistor setting value from the voltages provided by the voltage dividing circuit as a fourth gamma voltage; and a fourth output terminal to output the fourth gamma voltage set as a highest grayscale voltage of the second pixel area.

2. The gamma voltage generating circuit of claim 1, wherein:

the first to the fourth gamma voltages are set as gamma voltages of a bilinear gamma curve including a first linear section and a second linear section connected at an inflection point, and the third gamma voltage is a voltage corresponding to the inflection point.

3. The gamma voltage generating circuit of claim 2, wherein:

a slope of the second linear section is greater than a slope of the first linear section in the bilinear gamma curve, the first linear section is a linear voltage section between the first gamma voltage and the third gamma voltage, and the second linear section is a linear voltage section between the third gamma voltage and the fourth gamma voltage.

4. The gamma voltage generating circuit of claim 1, wherein:

the first to the fourth gamma voltages are set as gamma voltages of a gamma curve including a first curved section and a second curved section connected at an inflection point, the first curved section being distinct from the second curved section, and the third gamma voltage is a voltage corresponding to the inflection point.

5. The gamma voltage generating circuit of claim 4, wherein:

a slope of the second curved section is greater than a slope of the first curved section in the gamma curve, the first curved section is a curved voltage section between the first gamma voltage and the third gamma voltage, and the second curved section is a curved voltage section between the third gamma voltage and the fourth gamma voltage.

6. A display device, comprising:

a display panel including a first pixel area, a second pixel area, and a plurality of data lines respectively connected to pixels of the first pixel area and the second pixel area;

a data driver configured to supply a data voltage to the data lines; and a gamma voltage generating circuit configured to supply first, second, third, and fourth gamma voltages to the data driver, wherein the gamma voltage generating circuit comprises:

a first output terminal to output a first gamma voltage set as a black grayscale voltage;

a second output terminal to output a second gamma voltage set as a higher grayscale voltage of the black grayscale voltage;

a third output terminal to output a third gamma voltage set as a highest grayscale voltage of the first pixel area; and a fourth output terminal to output a fourth gamma voltage set as a highest grayscale voltage of the second pixel area, and wherein:

a first voltage range between the second gamma voltage and the fourth gamma voltage is greater than a second voltage range between the second gamma voltage and the third gamma voltage, and a third voltage range between the third gamma voltage and the fourth gamma voltage is less than a fourth voltage range between the second gamma voltage and the third gamma voltage.

7. The display device of claim 6, wherein a pixels-per-inch (PPI) of the second pixel area is smaller than a pixels-per-inch (PPI) of the first pixel area.

8. The display device claim 6, further comprising one or more sensor modules disposed under the display panel to at least partially overlap the second pixel area.

9. The display device of claim 6, wherein:

the first to the fourth gamma voltages are set as gamma voltages of a bilinear gamma curve including a first linear section and a second linear section connected at an inflection point, and the third gamma voltage is a voltage corresponding to the inflection point.

10. The display device of claim 9, wherein:

a slope of the second linear section is greater than a slope of the first linear section in the bilinear gamma curve, the first linear section is a linear voltage section between the first gamma voltage and the third gamma voltage, and the second linear section is a linear voltage section between the third gamma voltage and the fourth gamma voltage.

11. The display device of claim 6, wherein the gamma voltage generating circuit further comprises:

a voltage dividing circuit configured to receive a first reference voltage and a second reference voltage at two respective ends and to provide voltages having different voltage levels between the first reference voltage and the second reference voltage through voltage dividing nodes between the two ends;

a first multiplexer configured to output a voltage selected according to a first resistor setting value from the voltages provided by the voltage dividing circuit as the first gamma voltage;

a second multiplexer configured to output a voltage selected according to a second resistor setting value from the voltages provided by the voltage dividing circuit as the second gamma voltage;

a third multiplexer configured to output a voltage selected according to a third resistor setting value from the voltages provided by the voltage dividing circuit as the third gamma voltage; and a fourth multiplexer configured to output a voltage selected according to a fourth resistor setting value from the voltages provided by the voltage dividing circuit as the fourth gamma voltage.

12. The display device of claim 6, wherein:

the data driver includes a digital-to-analog converter (DAC) configured to convert input pixel data into the data voltage, and the first to the fourth gamma voltages are supplied to the digital-to-analog converter.

13. The display device of claim 6, wherein:

the first to the fourth gamma voltages are set as gamma voltages of a gamma curve including a first curved section and a second curved section connected at an inflection point, the first curve section being distinct from the second curved section, and the third gamma voltage is a voltage corresponding to the inflection point.

14. The display device of claim 13, wherein:

a slope of the second curved section is greater than a slope of the first curved section in the gamma curve, the first curved section is a curved voltage section between the first gamma voltage and the third gamma voltage, and the second curved section is a curved voltage section between the third gamma voltage and the fourth gamma voltage.

* * * * *